US008770576B2

(12) United States Patent
Kimura et al.

(10) Patent No.: US 8,770,576 B2
(45) Date of Patent: Jul. 8, 2014

(54) SHEET FEED UNIT AND IMAGE FORMING APPARATUS INCLUDING SAME

(71) Applicants: Ippei Kimura, Osaka (JP); Takamitsu Ikematsu, Osaka (JP); Kaoru Tada, Osaka (JP); Ikuo Fujii, Osaka (JP)

(72) Inventors: Ippei Kimura, Osaka (JP); Takamitsu Ikematsu, Osaka (JP); Yasuo Matsuyama, Hyogo (JP); Kaoru Tada, Osaka (JP); Ikuo Fujii, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/766,121

(22) Filed: Feb. 13, 2013

(65) Prior Publication Data

US 2013/0228962 A1 Sep. 5, 2013

(30) Foreign Application Priority Data

Mar. 1, 2012 (JP) ..... 2012-045461

(51) Int. Cl.
*B65H 1/00* (2006.01)

(52) U.S. Cl.
USPC ..... 271/145; 271/162; 271/164; 399/393

(58) Field of Classification Search
USPC ..... 271/145, 162, 164; 399/393
See application file for complete search history.

(56) References Cited

U.S. PATENT DOCUMENTS

| | | | | |
|---|---|---|---|---|
| 8,360,418 | B2 * | 1/2013 | Matsuyama et al. | 271/162 |
| 8,393,613 | B2 * | 3/2013 | Chen | 271/145 |
| 2012/0061907 | A1 * | 3/2012 | Matsuyama et al. | 271/145 |
| 2012/0063829 | A1 * | 3/2012 | Matsuyama et al. | 399/381 |

FOREIGN PATENT DOCUMENTS

| | | |
|---|---|---|
| JP | 4-246030 | 9/1992 |
| JP | 5-000740 | 1/1993 |
| JP | 9-002672 | 1/1997 |
| JP | 9-221236 | 8/1997 |
| JP | 2001-310825 | 11/2001 |
| JP | 2005-255363 | 9/2005 |
| JP | 2005-280980 | 10/2005 |
| JP | 2007-106545 | 4/2007 |
| JP | 2007-223689 | 9/2007 |
| JP | 2008-285264 | 11/2008 |
| JP | 2010052925 A * | 3/2010 |

* cited by examiner

*Primary Examiner* — Luis A Gonzalez
(74) *Attorney, Agent, or Firm* — Harness, Dickey & Pierce, P.L.C.

(57) ABSTRACT

A sheet feed unit includes a medium container configured to contain sheet-like recording media; a bottom plate disposed in the medium container and configured to accommodate the recording media thereon; a sheet feed device configured to feed out the recording media contained in the medium container; a main body of the sheet feed unit, which the medium container can be inserted into and pulled out from, including the sheet feed device; and a displaying member configured to display a remaining level of the recording media in the medium container, the displaying member including a first display oriented in a first direction and a second display oriented in a second direction perpendicular to the first direction. The sheet feed unit improves a freeness in the observable range of the displaying member and the remaining level of the recording media in the medium container can be more accurately ascertained.

19 Claims, 24 Drawing Sheets

SHEET FEED UNIT AND IMAGE FORMING APPARATUS INCLUDING SAME

CROSS-REFERENCE TO RELATED APPLICATION

The present application claims priority pursuant to 35 U.S.C. §119 from Japanese patent application number 2012-045461 filed on Mar. 1, 2012, the entire disclosure of which is incorporated by reference herein.

BACKGROUND

1. Technical Field

The present invention relates to a sheet feed unit capable of feeding a sheet-like recording medium, and further relates to an image forming apparatus such as a laser printer, a digital copier, and a facsimile machine including the sheet feed unit.

2. Related Art

A sheet feed unit of an image forming apparatus usually includes a single-step or multi-storied sheet feed tray, in which a plurality of sheet-like recording media can be stored and each sheet feed tray or sheet feed cassette is detachably attached to the main body of the image forming apparatus. The sheet feed tray is normally configured to be inserted into and pulled out from the main body of the image forming apparatus via an opening disposed at one side thereof.

When supplying the sheet or transmitting a print job, it is necessary to confirm whether or not the sheet is stored in the sheet feed tray externally. Recently, various approaches have been tried to enable the remaining paper supply level to be ascertained from outside, and image forming apparatuses including a display that shows a remaining paper supply level have been proposed. For example, JP-H09-2672-A discloses an apparatus including a slit window disposed on a front side wall, through which the number of sheets remaining in the sheet feed tray can be observed directly observed from outside. Alternatively, JP-2007-223689-A discloses an apparatus including a display mechanism, disposed on a cover of the sheet feed tray, to show the remaining paper supply level by contacting a top surface of the sheets inside the sheet feed tray.

Depending on where the image forming apparatus is installed, there may be an obstacle such as a wall in the direction to pull out the sheet feed tray from the main body, thereby obstructing insertion and removal of the sheet feed tray. To cope with the aforementioned problem, JP-H09-221236-A and JP-2005-255363-A propose an image forming apparatus which is configured to install a sheet feed tray in the image forming apparatus main body from two different directions. Even in such an image forming apparatus, however, a display showing a remaining level of the recording media may not be observed from outside or is difficult to be seen depending on the size of the obstacle and a positional relation between the obstacle and the sheet feed tray.

SUMMARY

The present invention provides an image forming apparatus comprising a sheet feed unit that is capable of allowing the remaining level of the recording media inside a medium container to be ascertained accurately by providing a greater observable range of the displaying member.

More specifically, the sheet feed unit includes a medium container in which sheet-like recording media is to be contained; a bottom plate on which the recording media is stackable; a sheet feed roller to feed out the recording media contained in the medium container; a sheet feed unit main body which the medium container can be inserted into and pulled out from and including the sheet feed unit; and a display to show a remaining level of the recording media contained in the medium container, in which the display includes a first display disposed in a first direction and a second display disposed in a second direction perpendicular to the first direction.

The sheet feed unit according to the present invention provides a greater observable range of the displaying part. Accordingly, a remaining level of the recording medium in the medium container can be more accurately ascertained.

These and other objects, features, and advantages of the present invention will become apparent upon consideration of the following description of the preferred embodiments of the present invention when taken in conjunction with the accompanying drawings.

BRIEF DESCRIPTION OF THE DRAWINGS

FIGS. 11A and 11B are enlarged oblique views of a corner of main body of the sheet feed unit, in which FIG. 11A shows a state in which the recording media is fully stacked and FIG. 11B shows that the sheet feed unit is empty of recording media;

FIGS. 12A and 12B are oblique views of the displaying member and a bottom plate illustrating a contacting state of the two, in which FIG. 12A shows a state in which the recording media is fully stacked and FIG. 12B shows that the sheet feed unit is empty of recording media;

FIGS. 13A and 13B are side views generally showing a mechanism to display a remaining level of the recording media, in which FIG. 13A shows a state in which the recording media is fully stacked and FIG. 13B shows a state in which the sheet feed unit is empty of recording media;

FIGS. 16A and 16B are views of a guide member, in which FIG. 16A shows a side view of the guide member and FIG. 16B shows an oblique view seen from its bottom;

FIGS. 17A and 17B are cross-sectional views illustrating operation of the guide member, in which FIG. 17A shows a state before the medium container is pulled out and FIG. 17B shows a final state in the pulling-out process of the medium container;

FIGS. 19A and 19B are views of the guide member, in which FIG. 19A shows a side view thereof and FIG. 19B shows an oblique view seen from its bottom;

FIGS. 22A and 22B are side views schematically illustrating a mechanism to display a remaining level of the recording medium, in which FIG. 22A shows a state in which the recording medium is fully stacked and FIG. 22B shows a state in which the sheet feed unit is empty of recording media;

FIGS. 28A and 28B are views illustrating a window portion formed at the corner portion, in which FIG. 28A is a front view thereof and FIG. 28B is a partially cross-sectional oblique view thereof.

DETAILED DESCRIPTION

Figure 1:
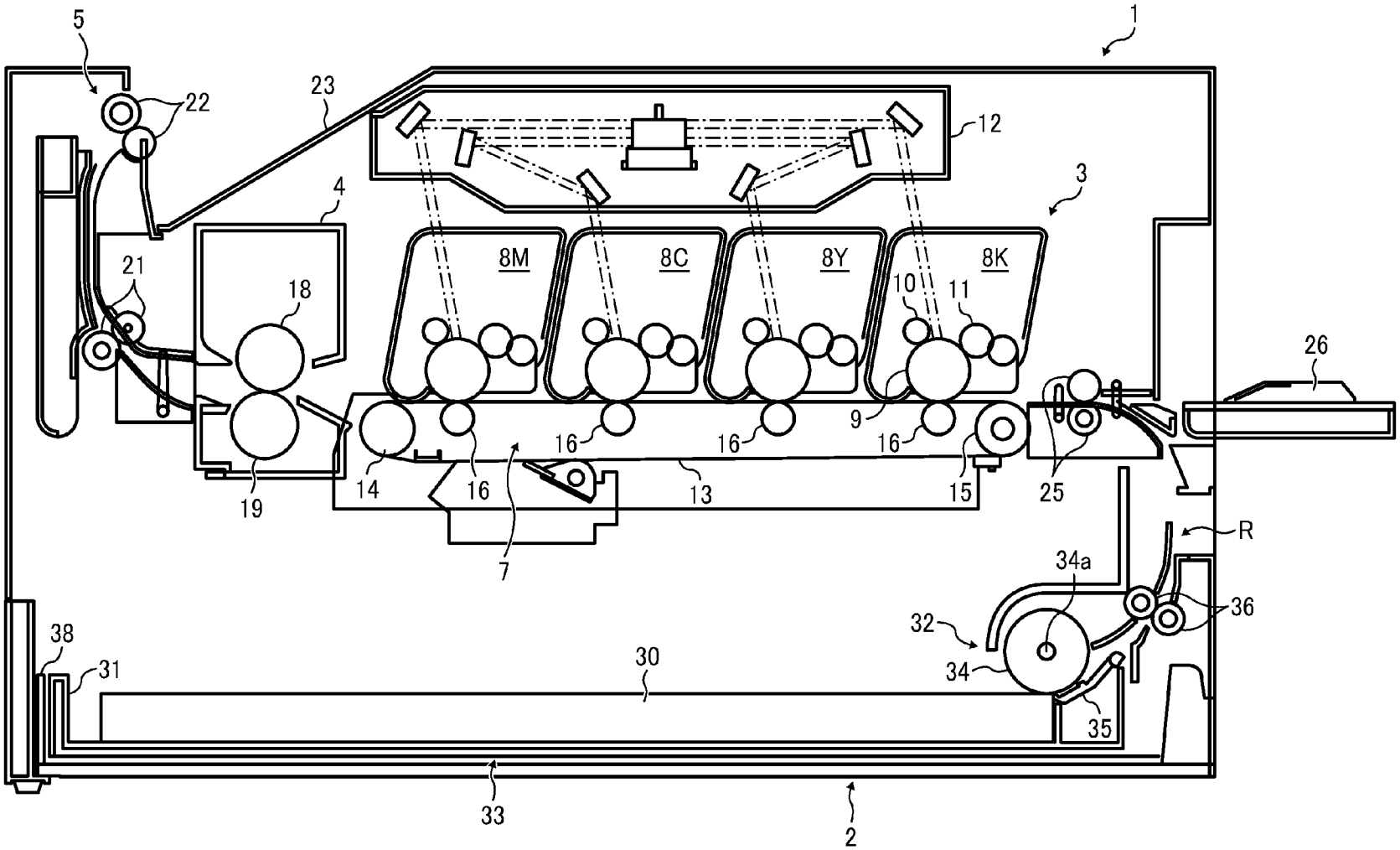
FIG. 1 is a cross-sectional view illustrating an overall structure of an image forming apparatus including a sheet feed unit according to the present invention.

FIG. 1 shows a color image forming apparatus 1 employing a general electrostatic image forming method as an example of the image forming apparatus of electrophotographic process. The image forming apparatus 1 includes a sheet feed unit 2 disposed at a bottom of the apparatus 1; an image forming section 3 disposed above the sheet feed unit 2; a fixing device 4 disposed downstream of the image forming section 3; and a discharge unit 5 disposed downstream of the fixing device 4.

The image forming section 3 as an image forming device includes a horizontally-disposed transfer belt unit 7 and four image forming units or developers 8M, 8C, 8Y, and 8K which are horizontally disposed side by side above the transfer belt 7. Each of the image forming units 8M, 8C, 8Y, and 8K is constructed identically to each other except that each unit includes a different color of developer among colors of magenta (M), cyan (C), yellow (Y), and black (K) corresponding to separated color components of a color image.

Each of the image forming units 8M, 8C, 8Y, and 8K includes a drum-shaped photoreceptor 9 as a latent image carrier; a charging roller 10 as a charging device to electrically charge a surface of the photoreceptor 9; a developing roller 11 to supply toner, as a developing device, onto the electrostatic latent image to be formed on the photoreceptor 9 and serving as a developing device; and a cleaner, not shown, to clean the surface of the photoreceptor 9. As illustrated in FIG. 1, the photoreceptor 9, the charging roller 10, and the developing roller 11 included in the image forming unit 8K are applied with reference numerals, and other reference numerals for the image forming units 8M, 8C, and 8Y are omitted.

An optical unit 12 as an exposure means is disposed above each of the image forming units 8M, 8C, 8Y, and 8K. The optical unit 12 includes a light source, a polygonal mirror, an fθ lens, a reflection mirror, and the like, and is configured to radiate laser beams while scanning each surface of the photoreceptor 9 based on image data.

The transfer belt unit 7 disposed below the image forming units 8M, 8C, 8Y, and 8K includes an endless transfer belt 13; a drive roller 14; and a driven roller 15, in which the transfer belt 13 is stretched around the drive roller 14 and the driven roller 15. Transfer rollers 16 each are disposed at a position opposed to the photoreceptor 9 of the image forming units 8M, 8C, 8Y, and 8K at an interior side of the transfer belt 13. Each of the four transfer rollers 16 sandwiches the transfer belt 13 together with the photoreceptor 9, thereby forming a transfer nip. In addition, each transfer roller 16 is connected with a power source, not shown, so that a transfer electric field is formed at the transfer nip between each transfer roller 16 and the photoreceptor 9.

The fixing device 4 includes a fixing roller 18 as a fixing member to fix an image onto the recording medium and a pressure roller 19 as an opposed member disposed opposite the fixing roller 18. The pressure roller 19 presses the fixing roller 18 at a predetermined pressure, thereby forming a fixing nip at the portion pressed by the pressure roller 19 and the fixing roller 18. A built-in heater, not shown, is disposed inside the fixing roller 18 serving as a heating means.

The discharge unit 5 includes a pair of feed rollers 21 and a pair of sheet-discharge rollers 22. The recording medium onto which the image is fixed at the fixing device 4 is conveyed via the feed roller pair 21 and the sheet-discharge roller pair 22 and discharged on a sheet-discharge tray 23 disposed on top of the main body of the image forming apparatus 1 with its surface reversed.

Next, with reference to FIG. 1, a basic operation of the printer according to an embodiment of the present invention will be described.

When an image forming operation is started upon receipt of a print job, a recording medium (hereinafter, to be referred to a sheet P) is fed to a conveyance path R from a stack of recording media 30 contained in the sheet feed unit 2. The sheet P fed out to the conveyance path R is sent to the transfer nip between the photoreceptor 9 and the transfer roller 16 at a timing defined by a pair of registration rollers 25. The recording medium may be alternatively supplied from a manual tray 26 disposed openably closable at a side of the main body of the image forming apparatus 1.

At the image forming units 8M, 8C, 8Y, and 8K, each photoreceptor 9 is driven to rotate clockwise by a driving device, not shown, and each surface of the photoreceptor 9 is uniformly charged at a predetermined polarity by a charger 10. Laser beams are irradiated from the optical unit 12 onto each surface of the photoreceptor 9 and an electrostatic latent image is formed on the surface of the photoreceptor 9. At this time, the image data exposed on each photoreceptor 9 is monochrome image data decomposed, from the target full-color image, into color data of yellow, magenta, cyan, and black. Each developing roller 11 supplies toner to the electrostatic latent image formed on the photoreceptor 9, so that the electrostatic latent image is rendered visible as a toner image.

In the meantime, the transfer belt 13 cyclically runs in the counterclockwise direction and the recording medium is sequentially fed to each transfer nip between the photoreceptor 9 and the transfer roller 16. Thereafter, upon the toner image of each color formed on the photoreceptor 9 reaching the transfer nip according to the rotation of each photoreceptor 9, the toner image of each color formed on each photoreceptor 9 is sequentially transferred in a superposed manner on the recording medium by the transfer electric field formed at the transfer nip. Thus, a full-color toner image is carried on the surface of the recording medium. In addition, the residual toner which has not been transferred to the recording medium and is remaining on each photoreceptor 9 is removed by the cleaner, not shown. Thereafter, the surface of each photoreceptor 9 is electrically discharged by a discharger, not shown, and the surface potential is initialized.

The recording medium is then conveyed to the fixing device 4, and the toner image on the recording medium is fixed onto the recording medium by being pressed and heated at the fixing nip. The recording medium is then discharged outside the apparatus by a sheet discharging device 5, and is stacked on a sheet discharge tray 23.

The explanation heretofore relates to an image forming operation when a full-color image is formed on the sheet; however, a monochrome image may be formed using any one of the four image forming units 8M, 8C, 8Y, and 8K and an image employing two or three colors may be created by using two or three image forming units.

The structure and operation of the sheet feed unit 2 mounted in the image forming apparatus 1 will now be described.

The sheet feed unit 2 is deposed below the image forming apparatus 1 and includes a medium container 31 (for example, a sheet feed tray) in which a stack of recording media is stacked and contained, a sheet feed device 32 to feed out the recording medium from the stack of recording media 30 included in the medium container 31, a main body of the sheet feed unit 33, and a support frame 38 disposed at an exterior of the medium container 31. In addition to a regular sheet, the recording medium is defined to include various sheets such as a cardboard, a postcard, an envelop, thin paper, coated paper or art paper, tracing paper, an OHP sheet, and the like. The stack of recording media 30 means a plurality of sheet-like recording media stacked in layers.

The sheet feed device 32 includes a sheet feed roller 34 as a sheet feed means supported by a rotary shaft 34*a*; a separation pad 35 serving as a separating member so disposed as to oppose the sheet feed roller 34; a pair of conveyance rollers 36; the registration roller pair 25; and the conveyance path R. In the sheet feed device 32, because a rotary sheet feed roller 34 presses against a topmost sheet of the stack of recording media 30, a feeding force is given to the recording medium. Then, the recording media are separated one by one via a separation pad 35 formed of a material having a high friction coefficient, and the separated recording medium is conveyed, through the conveyance roller 36, to the conveyance path R, and reaches the pair of registration rollers 25, where a leading end of the recording medium is aligned by the pair of registration rollers 25. It is to be noted that, alternatively, a belt unit may be used as a sheet feeding means instead of the sheet feed roller 34.

Figure 2:
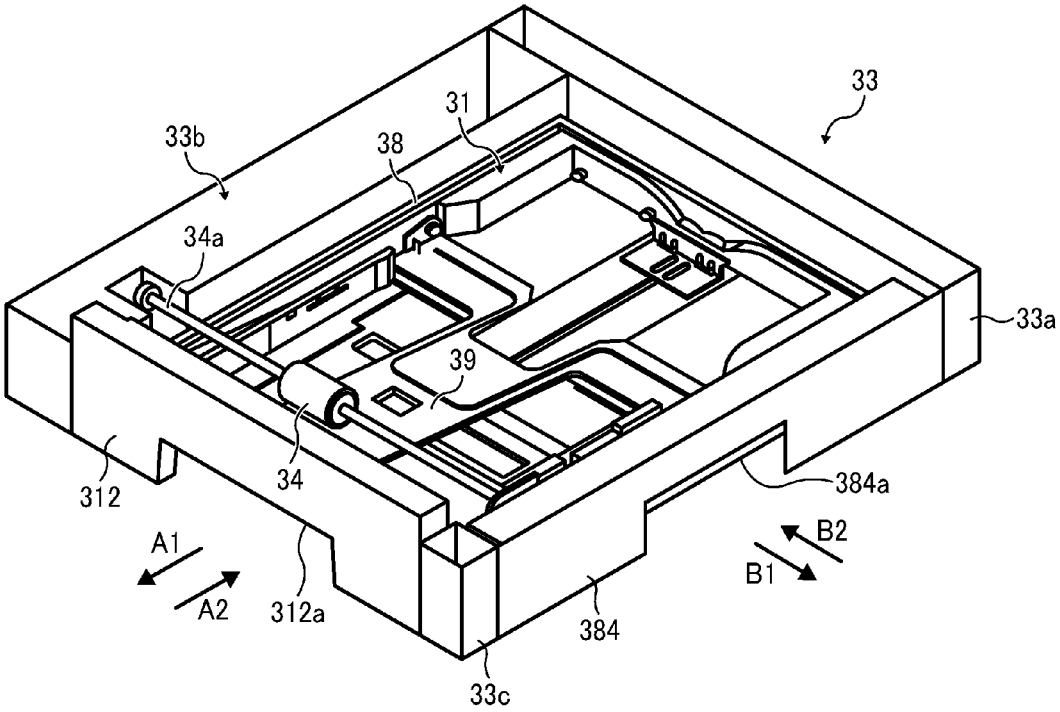
FIG. 2 is an oblique view of the sheet feed unit in FIG. 1.
Figure 3:
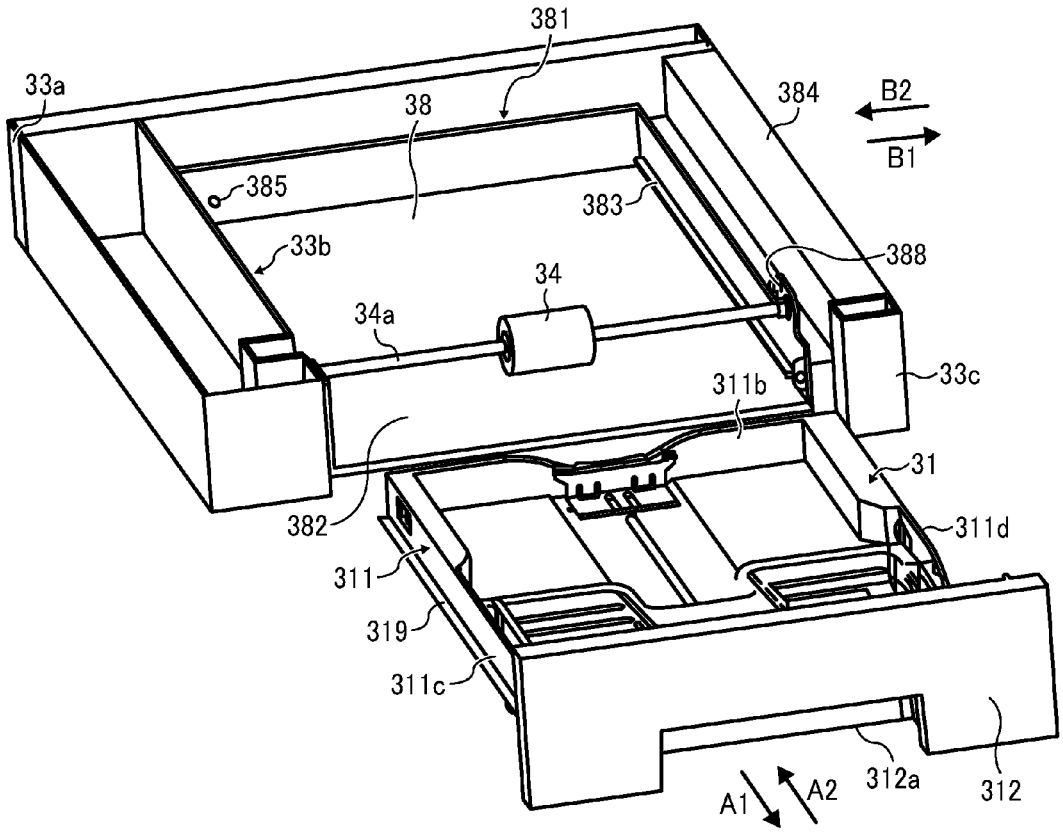
FIG. 3 is an oblique view of the sheet feed unit in a state in which a medium container is pulled out in a first removal direction.

As illustrated in FIGS. 2 and 3, the sheet feed unit 2 includes the main body of the sheet feed unit 33 which includes a back side frame 33*a*, a side frame 33*b*, and a pillar 33*c*. The medium container 31 is disposed in an interior space surrounded by the back side frame 33*a*, the side frame 33*b*, and the pillar 33*c*. The medium container 31 is so configured as to be pulled out in a direction A1, which is the sheet feed direction performed by the sheet feed roller 34, and a direction B1, which is the direction perpendicular to the sheet feed direction.

Further, in the description below, the A1 direction is defined as "the first removal direction" and the B1 direction is defined as "the second removal direction." In addition, an insertion direction A2 which is the direction reverse to the first removal direction when the medium container 31 pulled out in the first removal direction A1 is inserted to the main body of the sheet feed unit 33 is called "the first insertion direction." Similarly, an insertion direction B2 which is the direction reverse to the second removal direction when the medium container 31 pulled out in the second removal direction B1 is inserted to the main body of the sheet feed unit 33 is called "the second insertion direction." Further, the pulling out operation in the first removal direction A1 and the inserting operation in the first insertion direction A2 is called "a first operation" inclusively, and the pulling out operation in the second removal direction B1 and the inserting operation in the second insertion direction B2 is called "a second operation" inclusively.

Hereinafter, a structure enabling the medium container 31 to perform the first operation and the second operation will now be described with reference to FIGS. 2 to 8. It is to be noted that FIGS. 2 to 8 each show a state in which the main body of the sheet feed unit 33 is not provided with a remaining level displaying unit 50, to be described later.

Figure 4:
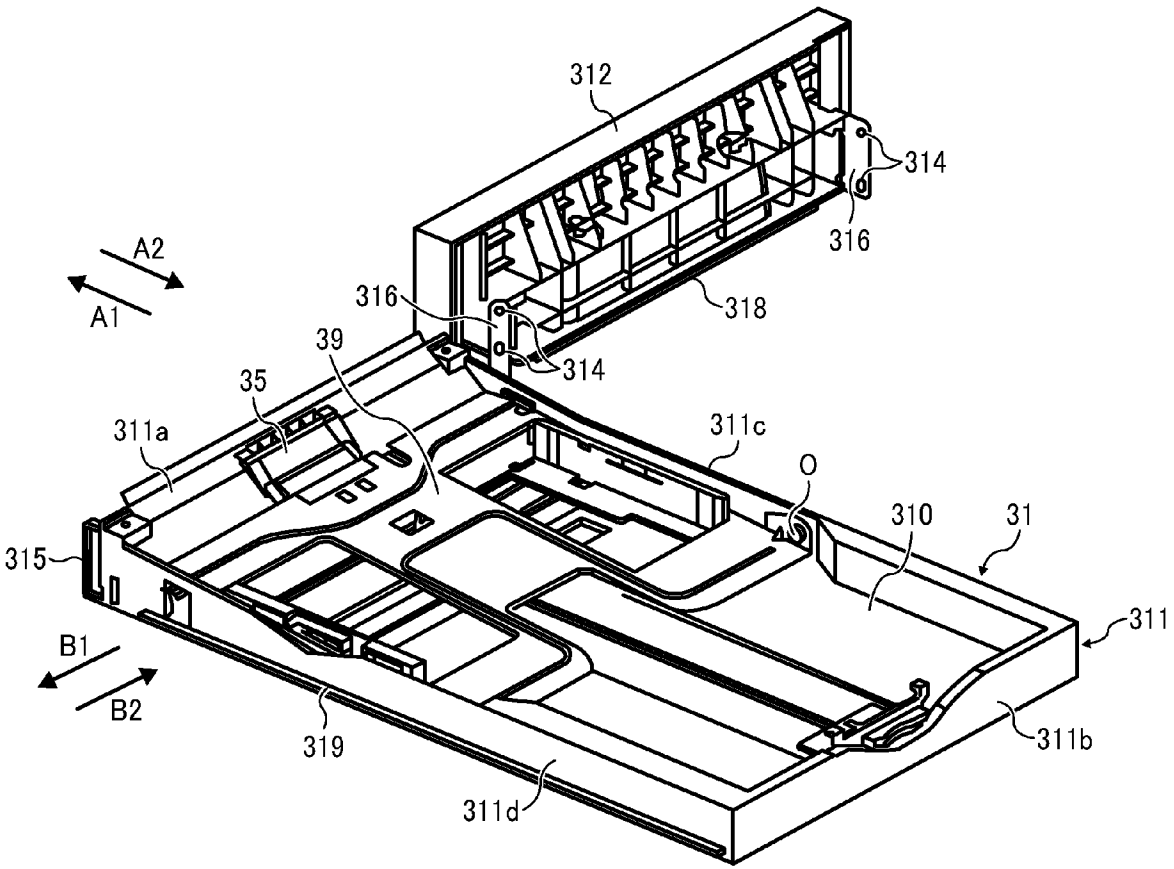
FIG. 4 is an oblique view of the medium container and a first covering unit.
Figure 5:
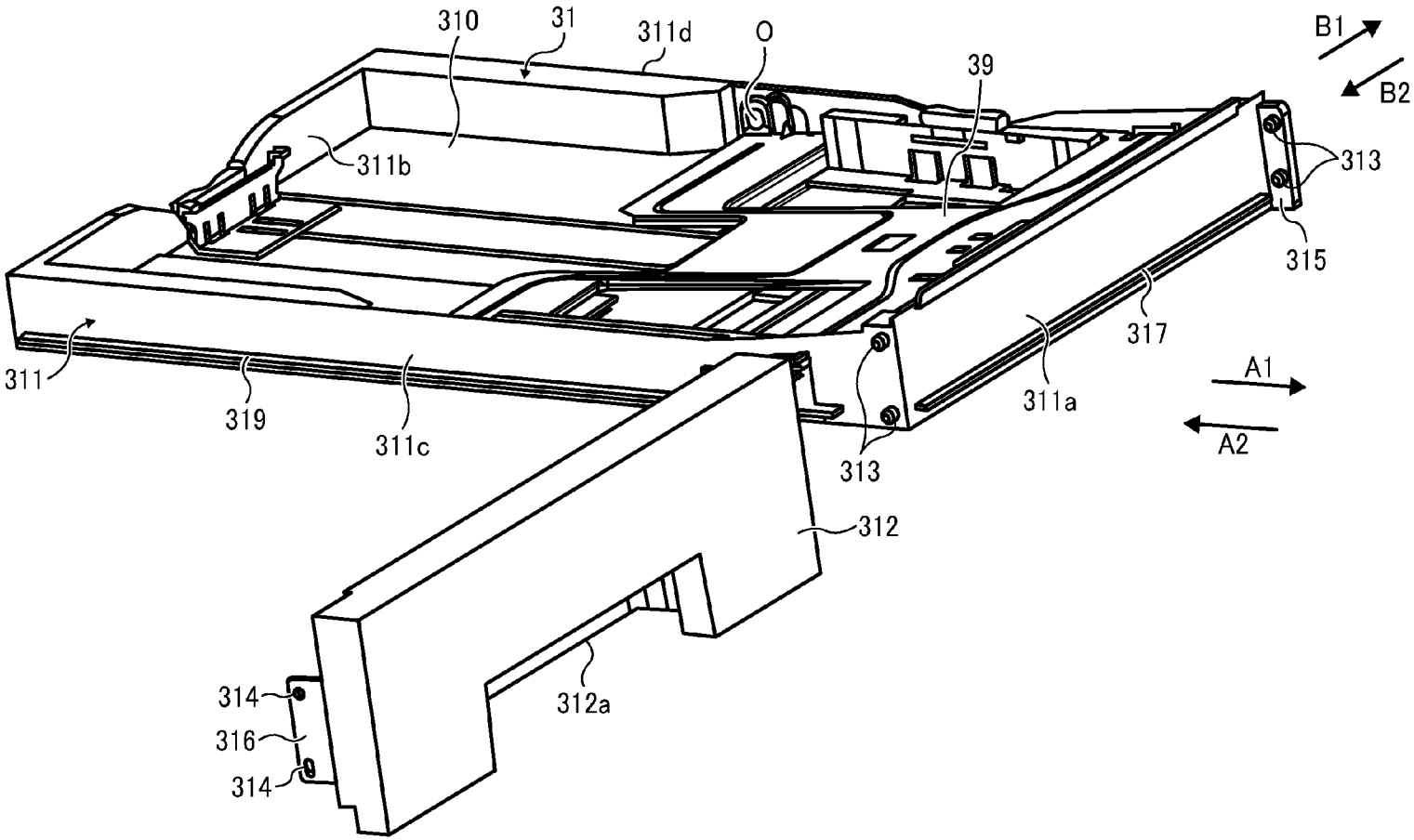
FIG. 5 is an oblique view of the medium container and the first covering unit observed from a direction reverse to the direction shown in FIG. 4.

FIGS. 4 and 5 show the medium container 31 which is separated from the support frame 38. The medium container 31 includes a rectangular bottom wall 310 and a peripheral wall 311 which is extended from a periphery of the bottom wall 310 upwardly to form a wall in four directions of the bottom wall 311. The peripheral wall 311 includes a front wall 311*a*, a rear wall 311*b*, and a pair of side walls 311*c* and 311*d*. The front wall 311*a* includes a separation pad 35.

The bottom wall 310 is provided with a bottom plate 39 to lift up a side of the first removal direction A1 of the stack of recording media 30 contained in the medium container 31. The bottom plate 39 covers substantially half the area of the side of the first removal direction A1 of the bottom wall 310. Base ends of the bottom plate 39 are fixed on a support axis O of the pair of side walls 311*c* and 311*d* so that the bottom plate 39 is movable about the support axis O. An elastic member, not shown, is disposed between the bottom plate 39 and the bottom wall 310. The bottom plate 39 is constantly pressed in such a direction that a leading end 39*a* is lifted up by the elastic member. The bottom plate 39 may be pressed by the elastic member; and alternatively, the bottom plate 39 may be lifted up and down driven by a motor device.

The first covering unit or plate 312 includes a gripper 312*a* at a bottom center of an external surface and is disposed on the outside of the front wall 311*a*. The first covering unit 312 is detachably attached to the medium container 31 via a male joint 313 (for example, a pin) and a female joint 314 (for example, a hole) so as to realize the second operation enabling attachment/detachment in the second removal direction B1 and the second insertion direction B2. Either of the male joint 313 and the female joint 314 is disposed on the medium container 31 and the rest of the two is disposed on the first covering unit 312. As illustrated in FIGS. 4 and 5, a pair of male joints 313 is vertically disposed on the peripheral wall 311 of the medium container 31 and a pair of female joints 314 is vertically disposed on the first covering unit 312.

More specifically, a first protrusion 315 protruding in the first removal direction A1 is disposed at an edge of the front wall 311*a* of the medium container 31 in the second removal direction B1. Second protrusions 316, each protruding in the first insertion direction A2, are disposed on both edges of an internal surface of the first covering unit 312. The male joint 313 protrudes in the second insertion direction B2 and is disposed on an edge of the other side wall 311*c* in the first removal direction A1 and on the first protrusion 315, respectively. The pair of female joints 314 is disposed on the two second protrusions 316, respectively. The male joint 313 disposed on the other side wall 311*c* is positioned in the first insertion direction A2 than the male joint 313 disposed on the first protrusion 315.

As illustrated in FIG. 5, a guide rail 317 extending along the second operation direction B1 or B2 is disposed below an outside surface of the front wall 311*a* of the medium container 31. As illustrated in FIG. 4, a guide rail 318 extending along the second operation direction B1 or B2 is disposed below at an interior surface of the medium container 31. The guide rails 317 and 318 slidably move over each other so that the first covering unit 312 and the front wall 311*a* relatively move in the second operation direction B1 or B2.

When the guide rail 317 of the medium container 31 and the guide rail 318 of the first covering unit 312 are slid together and the first covering unit 312 is moved in the second removal direction B1 from a state as illustrated in FIG. 5, the male joint 313 of the medium container 31 engages with the female joint 314 of the first covering unit 312 and the first covering unit 312 is attached to the front wall 311*a* (see FIG. 3). In the state as described above, when the first covering unit 312 is pushed or pulled in the first operation directions A1 and A2, because the male joint 313 and the female joint 314 are engaged together, the first covering unit 312 and the medium container 31 are integrally moved in the same direction.

Conversely when the first covering unit 312 is moved in the second insertion direction B2 as illustrated in FIG. 4 from the state as described above, the male joint 313 disengages from the female joint 314 so that the first covering unit 312 can be separated from the medium container 31.

Figure 6:
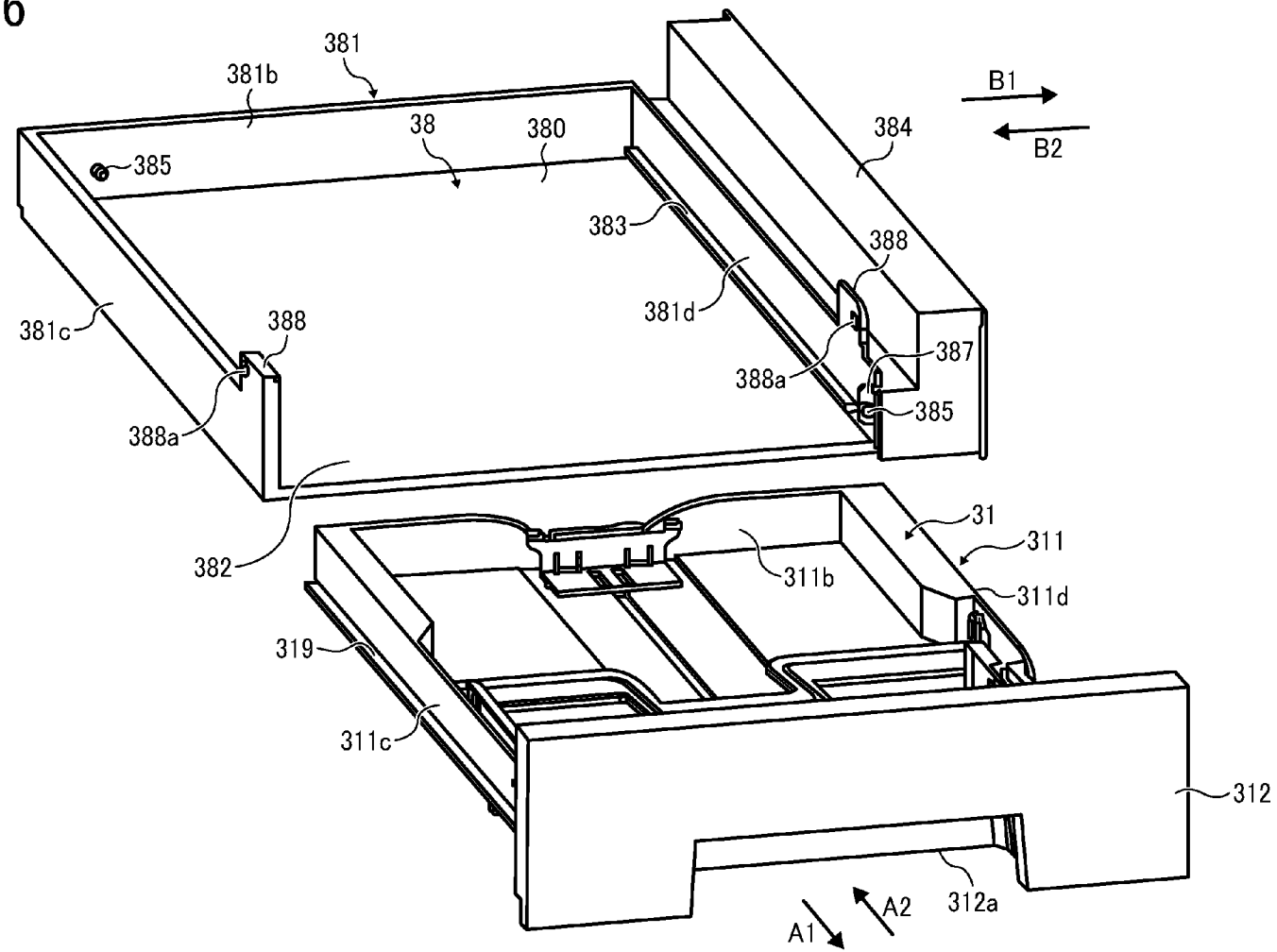
FIG. 6 is an oblique view illustrating the sheet feed unit and a support frame in a separated state.

Here, as illustrated in FIG. 6, the support frame 38 to support the medium container 31 outside the medium container 31 includes a bottom wall 380 and a peripheral wall 381 which is extended upwardly from a periphery of the bottom wall 380. The peripheral wall 381 forms three sides of the rectangular bottom wall 380, which are a rear wall 381*b* and a pair of side walls 381*c* and 381*d*. One direction of the peripheral wall 381 is left open and the part without any wall serves as an inlet 382 for the medium container 31. An internal width between the pair of side walls 381*c* and 381*d* of the support frame 38 is slightly larger than an external width between the pair of side walls 311*c* and 311*d*.

Guide rails 383 extending along the first operation directions B1 and B2 are disposed each at the bottom of the pair of side walls 381*c* and 381*d* of the support frame 38. To correspond to the guide rails 383, guide rails 319 extending along the first operation directions A1 and A2 are disposed at the bottom of the pair of side walls 311*c* and 311*d* of the medium container 31. When the guide rails 319 and 383 slidably move over each other, the medium container 31 moves in the first operation directions A1 and A2 reciprocally, relatively to the support frame 38.

A second covering unit 384 includes a gripper 384*a* (see FIG. 2) at a bottom center of an external surface thereof and is disposed on the outside of the other side wall 381*d* of the support frame 38. The first covering unit 312 is detachably attached to the front wall 311*a* of the medium container 31; however, alternatively, the second covering unit 384 may be fixed on the side wall 381*d*. With this structure, the entire apparatus can be manufactured at a low cost by reducing the number of parts to be used.

Figure 7:
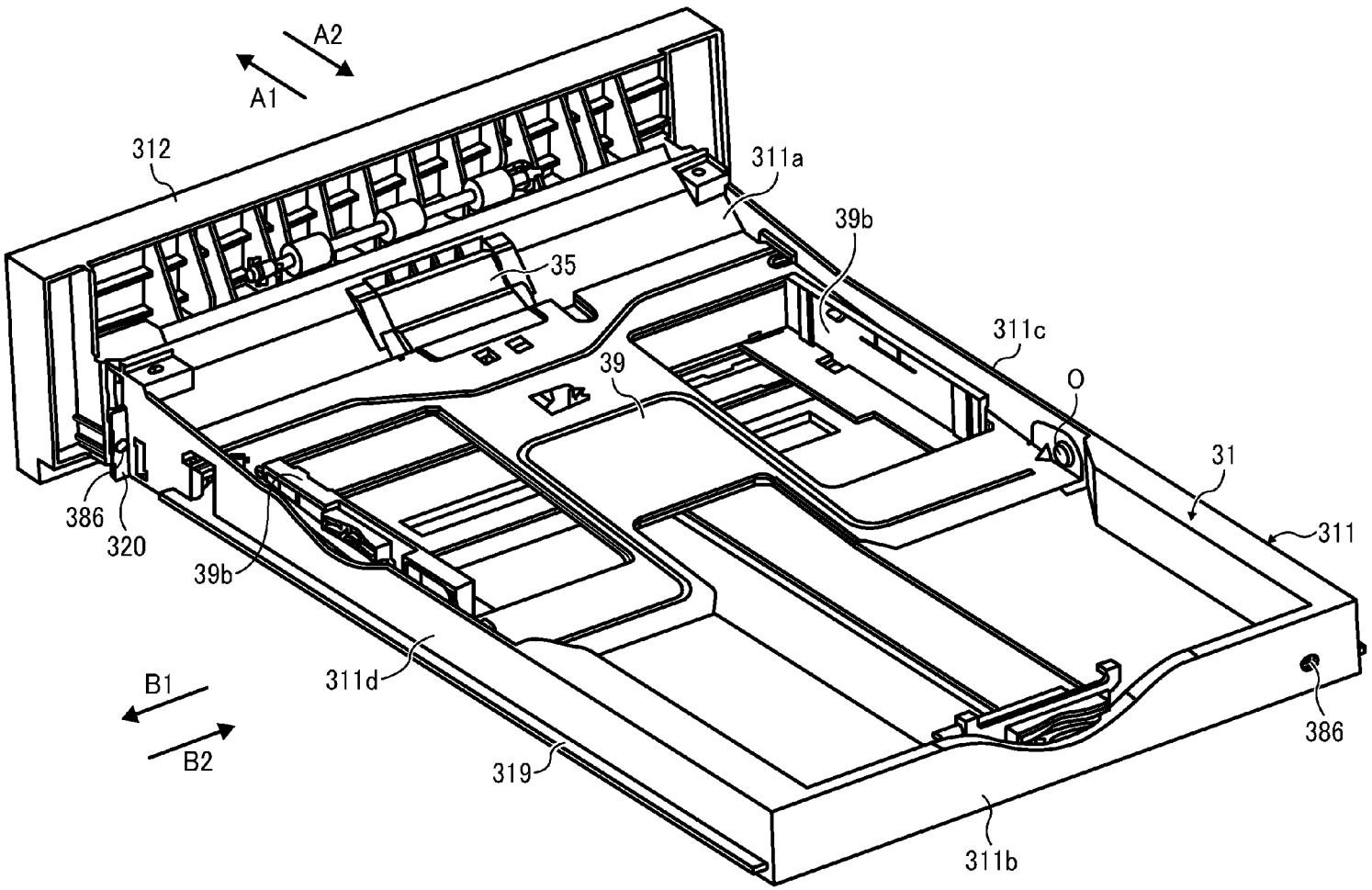
FIG. 7 is an oblique view of the medium container seen from a distal side.

The medium container 31 and the support frame 38 can be detachably attached via a male joint 385 (for example, a pin) and a female joint 386 (for example, a hole) which are insertible/disengageable in the first operation directions A1 and A2. Either of the male joint 385 and the female joint 386 is disposed to the support frame 38 and the rest are disposed to the medium container 31. FIGS. 6 and 7 show a case in which the male joint 385 is disposed on the support frame 38 and the female joint 386 is disposed on the medium container 31.

As illustrated in FIG. 6, a third protrusion 387 protruding in the second insertion direction B2 is disposed at an edge of the side wall 381*d* of the support frame 38 toward the side of the first removal direction A1. Further, as illustrated in FIG. 7, a fourth protrusion 320 protruding in the second removal direction B1 is disposed at an edge of the other side wall 311*d* of the medium container 31 toward the side of the first removal direction A1. As illustrated in FIG. 6, the male joints 385 are formed on an edge of the second insertion direction B2 of the rear wall 381*b* of the support frame 38 and on the third protrusion 387, respectively, and both are protruded in the first removal direction A1. Further, as illustrated in FIG. 7, the female joints 386 are formed at an edge of the second insertion direction B2 of the rear wall 311*b* and on the fourth protrusion 320, respectively.

When the medium container 31 is pushed in the first insertion direction A2 together with the first covering unit 312 and the medium container 31 is inserted into the support frame 38 through the inlet 382 from the state as illustrated in FIG. 6, the male joint 385 disposed at the support frame 38 engages with the female joint 386 disposed on the medium container 31. In this state, when the support frame 38 is pushed or pulled in the second operation directions B1 and B2 by holding the gripper 384*a* of the second covering unit 384, because the male joint 385 and the female joint 386 are engaged together, the support frame 38 and the medium container 31 are integrally moved in the same direction.

On the other hand, when the medium container 31 is pulled in the first removal direction A1 from the support frame 38 by holding the gripper 312*a* of the first covering unit 312, the male joint 385 of the support frame 38 disengages from the female joint 386 of the medium container 31 so that the medium container 31 can be separated from and pulled out from the support frame 38.

As illustrated in FIG. 6, extensions 388 each having a support hole 388*a* are disposed at both opening edges of the pair of side walls 381*c* and 381*d*. The sheet feed roller 34 includes a rotary shaft 34*a* (see FIG. 3). Both ends of the rotary shaft 34*a* of the sheet feed roller 34 are inserted to the support holes 388*a* of the extensions 388 and a roller bearing, not shown, is disposed between the rotary shaft 34*a* and the extensions 388, so that the sheet feed roller 34 is rotatably supported relative to the support frame 38 above the inlet 382. The rotary shaft 34*a* of the sheet feed roller 34 is brought parallel to the second operation directions B1 and B2.

Figure 8A:
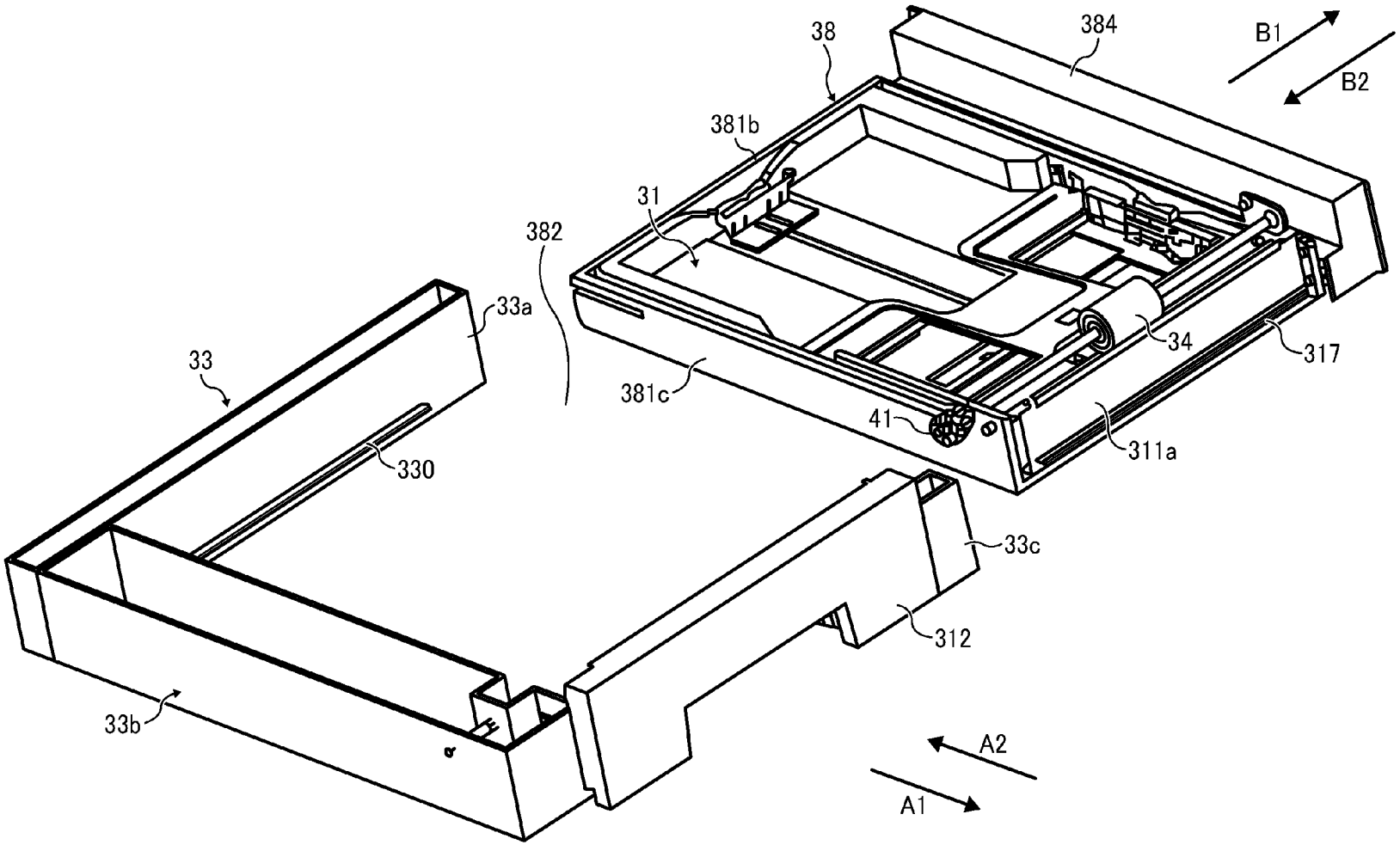
FIGS. 8A to 8C are oblique views illustrating the sheet feed unit from which the medium container is pulled out in a second removal direction.
Figure 8B:
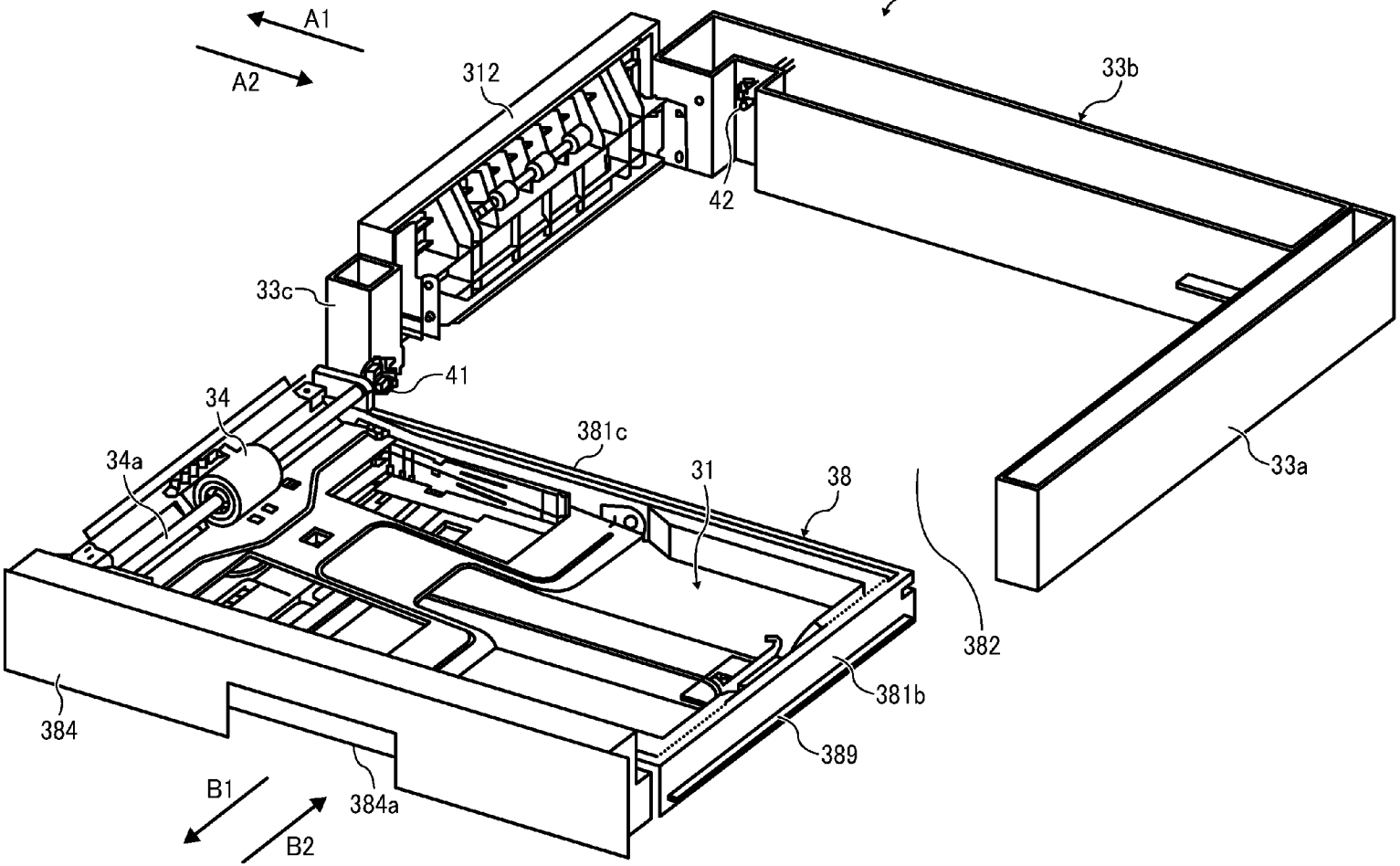
Figure 8C:
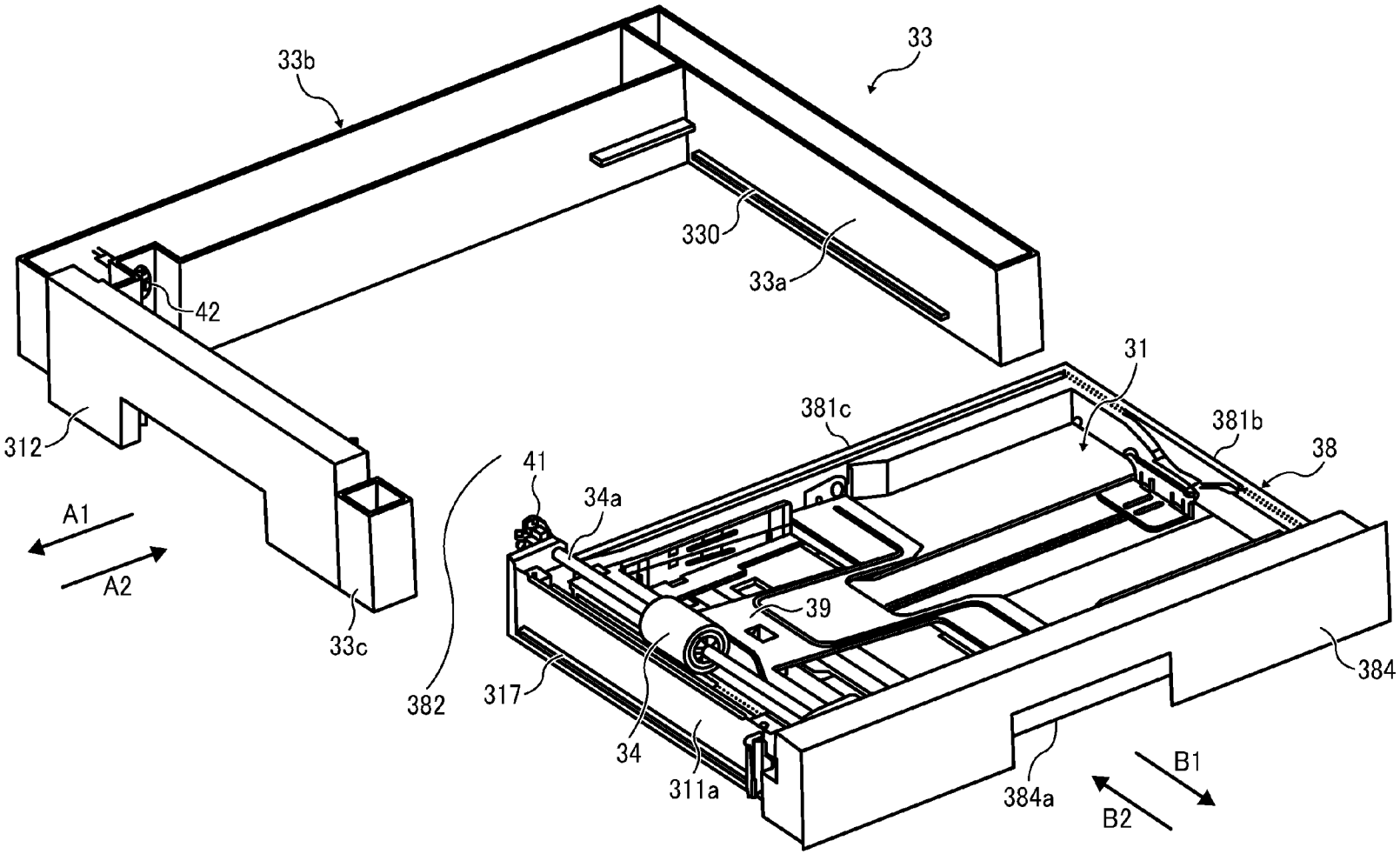

As illustrated in FIGS. 8A to 8C, the rotary shaft 34*a* of the sheet feed roller 34 is provided with a gear 41 as a torque transmitter. The gear 41 is disposed at an edge in the second insertion direction B2 of the rotary shaft 34*a*. An intermediate gear 42 which transmits a torque to the gear 41 is rotatably supported on the side frame 33*b* of the main body of the sheet feed unit 33. If the support frame 38 is contained in the main body of the sheet feed unit 33, the gear 41 of the rotary shaft 34*a* is engaged with the intermediate gear 42. Accordingly, when the intermediate gear 42 is driven via the rotary drive source, not shown, the sheet feed roller 34 is rotated via the gear 41, so that the recording medium can be conveyed. If the support frame 38 is moved in the second removal direction B1 from this state, engagement of the gear 41 with the intermediate gear 42 is released, and while the gear 41, the rotary shaft 34*a*, and the sheet feed roller 34 moving in the same direction together with the support frame 38, the intermediate gear 42 remains at the side frame 33*b* of the main body of the sheet feed unit 33.

As illustrated in FIGS. 8A to 8C, a guide rail 330 extending along the second operation directions B1 and B2 is disposed low on an interior surface of the back side frame 33*a* of the medium container 33. As illustrated in FIG. 8B, a guide rail 389 corresponding to the guide rail 330 and extending along the second operation directions B1 and B2 is disposed low on an outside surface of the rear wall 381*b* of the support frame 38.

In a state as illustrated in FIG. 2, the medium container 31 and the sheet feed roller 34 are supported by the main body of the sheet feed unit 33 via the support frame 38. When a gripper 312*a* of the first covering unit 312 is taken to pull out the first covering unit 312 in the first removal direction A1 from the state as illustrated in FIG. 3, the guide rail 319 of the medium container 31 and the guide rail 383 of the support frame 38 are slid together so that the first covering unit 312 and the medium container 31 is integrally pulled out in the same direction. In this case, because the second covering unit 384 mounted on the support frame 38 interferes with the pillar 33*c*, the support frame 38 is remained in the main body of the sheet feed unit 33. In addition, the sheet feed roller 34 supported by the support frame 38 is remained in the main body of the sheet feed unit 33. Then, when the first covering unit 312 is pushed back in the first insertion direction A2, the first covering unit 312 and the medium container 31 integrally move so as to be contained in the main body of the sheet feed unit 33 through the inlet 382, and returns to a state as illustrated in FIG. 2.

On the other hand, as illustrated in FIGS. 8A to 8C, when the gripper 384*a* of the second covering unit 384 is taken to pull out the second covering unit 384 in the second removal direction B1, the guide rail 389 of the support frame 38 and the guide rail 330 of the main body of the sheet feed unit 33 are slid together and the guide rail 318 of the first covering unit 312 and the guide rail 317 of the medium container 31 are slid together, respectively, so that the support frame 38 and the medium container 31 are integrally pulled out in the same direction (see FIGS. 4 and 5). At this time, the sheet feed roller 34 supported by the support frame 38 is also pulled out following the support frame 38. On the other hand, because the first covering unit 312 does not follow the medium container 31 because it interferes with the pillar 33*c* and is remained in the main body of the sheet feed unit 33. Then, when the second covering unit 384 is pushed back in the second insertion direction B2, the second covering unit 384, the support frame 38, the medium container 31, and the sheet feed roller 34 integrally move, are contained in the main body of the sheet feed unit 33 and the configuration returns to the state as illustrated in FIG. 2.

By employing the above structure, inserting and pulling out the medium container 31 along the two directions is enabled. Accordingly, even though there is an obstacle existing in one direction and insertion/removal of the medium container 31 is not possible, the medium container 31 can be inserted or pulled out from the apparatus main body in the other insertion/removal direction. Thus, the recording medium can be supplied and a paper jam removal work can be performed even under the obstacle existing condition so that the apparatus can be installed at various different places.

When pulling out the medium container 31 in the second removal direction B1, because the sheet feed roller 34 is configured to be pulled out accompanied by the medium container 31, there is no need of providing a device to push down the bottom plate 39 when the recording medium is remained in the medium container 31. Further, because the separation pad 35 is also pulled out toward an exterior in addition to the sheet feed roller 34, there is no need of releasing a hold of the recording medium held between the separation pad 35 and the sheet feed roller 34 in the pulling out operation in the second removal direction B1. As a result, insertion/removal of the medium container 31 in two directions can be accomplished at a low cost.

Although a detailed description is omitted, it is preferred that a lock mechanism be provided between the medium container 31 and the support frame 38 so that separation of the two is prevented in a state in which the medium container 31 and the support frame 38 are integrally pulled out by the second operation.

Next, a structure of the remaining level displaying unit 50 will now be described.

Figure 9:
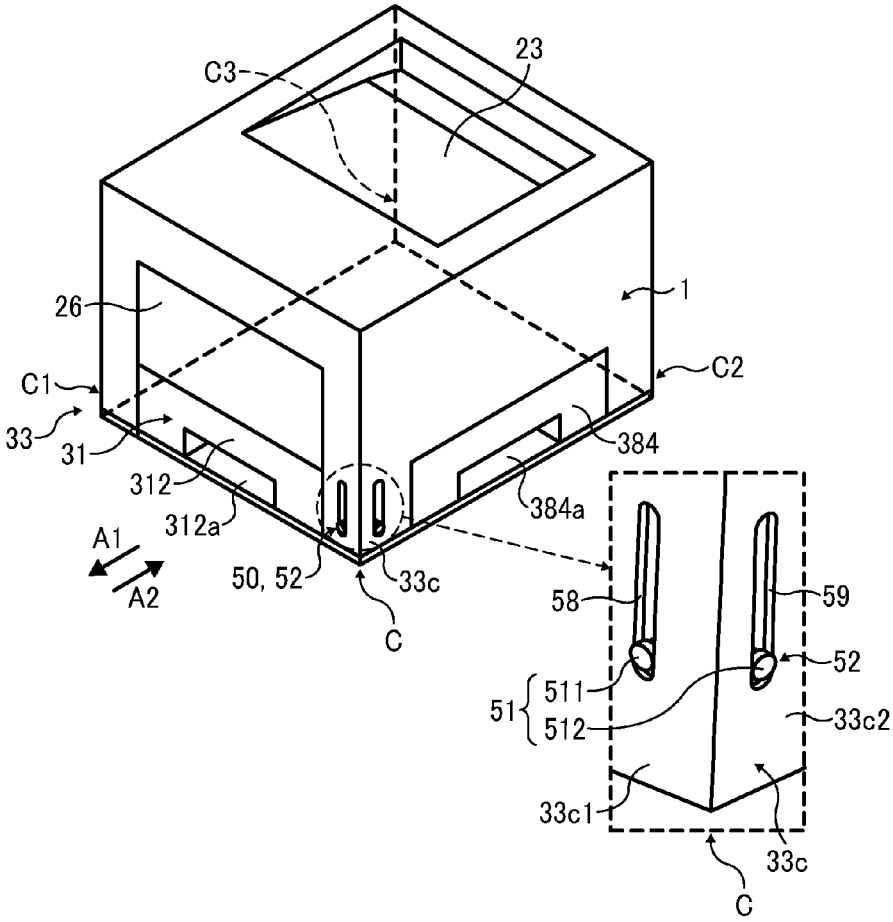
FIG. 9 is an oblique view of the image forming apparatus illustrating its overall structure and an enlarged partial view thereof.

As illustrated in FIG. 9, the remaining level displaying unit 50 serves to display a remaining level of the recording medium contained in the medium container 31.

Figure 10:
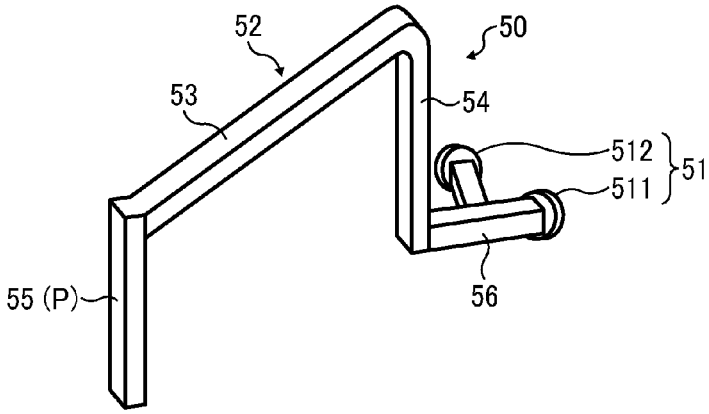
FIG. 10 is an oblique perspective view illustrating a displaying member.

Further, as illustrated in FIG. 10, the remaining level displaying unit 50 according to an embodiment of the present invention includes a displaying member 52 that includes two displays 51. That is, the displaying member 52 includes a horizontally extending base 53, two legs 54 and 55 extending downwards from both ends of the base 53, a joint 56 horizontally extending from one end of the leg 54, and the displays 51 disposed at each leading edge of the joint 56, which are integrally formed using a resin material, for example. The joint 56 extends in a first direction and a second direction. The display 51 (including a first display 511 and a second display 512) is disposed at each extended end of the joint 56. Further, in the description below, the A1 direction is defined as "the first removal direction" and the B1 direction is defined as "the second removal direction." That is, the first direction is perpendicular to the second direction.

Figure 11A:
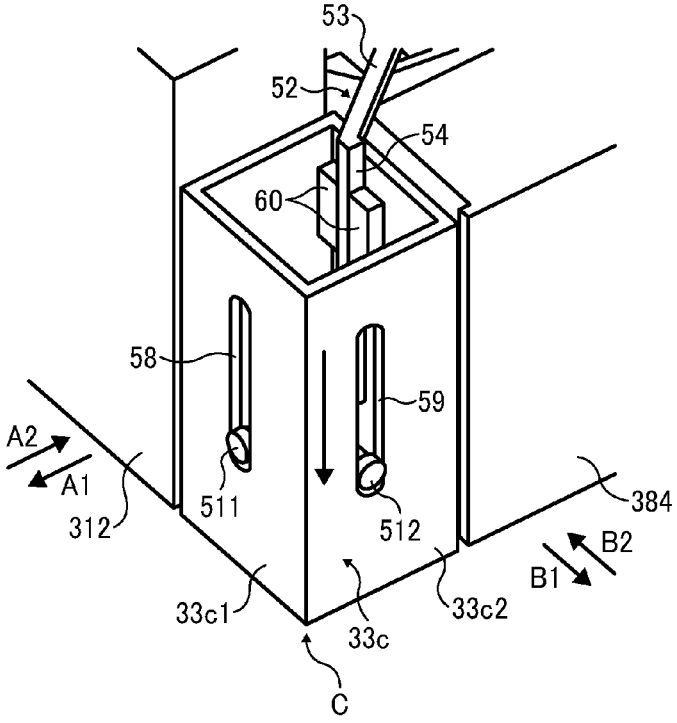
Figure 11B:
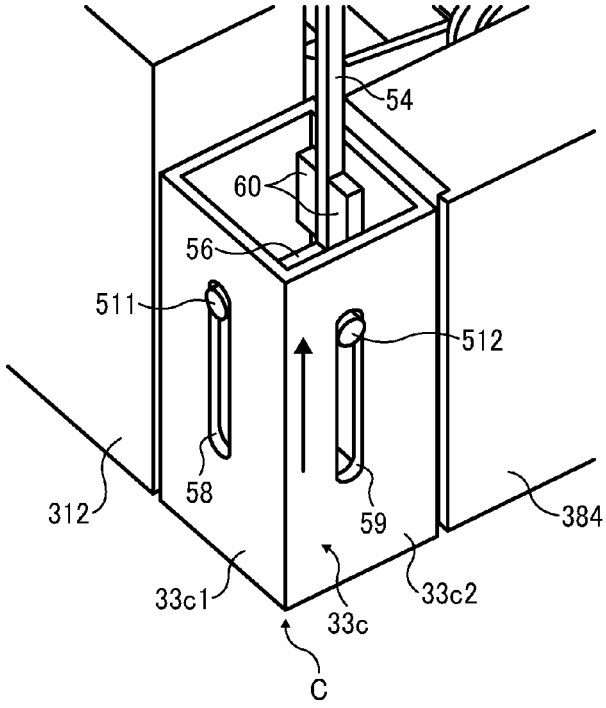

As illustrated in FIGS. 11A and 11B, a bottom end of the leg 54, the joint 56, and the display 51, each as a member of the displaying member 52 are contained inside the hollow pillar 33*c*. The pillar 33*c* is so positioned as to be adjacent to each of a passing area where the medium container 31 passes when the medium container 31 is pulled out in the first removal direction A1 and another passing area where the medium container 31 passes when the medium container 31 is pulled out in the second removal direction B1. The pillar 33*c* is formed to have a rectangular cross-section and has a first exterior surface 33*c*1 perpendicular to the first removal direction A1 and a second exterior surface 33*c*2 perpendicular to the second removal direction B1. Where the first exterior surface 33*c*1 and the second exterior surface 33*c*2 join, they form a corner section C.

The first exterior surface 33*c*1 and the second exterior surface 33*c*2 each include a window 58 and a window 59 that vertically extend to form slots, respectively. The first display 511 of the displaying member 52 is disposed at the window 58 formed in the first exterior surface 33*c*1 and the second display 512 is disposed at the window 59 in the second exterior surface 33*c*2. Accordingly, the first display 511 is oriented in the first removal direction A1 and the second display 512 is oriented in the second removal direction B1. The first and second displays 511 and 512 are vertically slidable within the windows 58 and 59 accompanied by a vertical movement of the displaying member 52. As described above, the windows 58 and 59 are formed in the pillar 33*c* and the first and second displays 511 and 512 are disposed at the windows 58 and 59, respectively, whereby other parts of the displaying member 52 are protected by the first exterior surface 33*c*1 and the second exterior surface 33*c*2 and the displaying member 52 is prevented from being damaged by an unintentional external force.

A vertical movement of the leg 54 is guided by a guide 60 disposed on an interior surface of the pillar 33*c*, so that the vertical movement of the displaying member 52 is smoothly performed. However, the guide 60 can have any arbitrary shape as long as it can guide to move the leg 54 freely and vertically. FIGS. 11A and 11B illustrate an example of the guide 60 which sandwiches both sides of the leg 54.

Figure 12A:
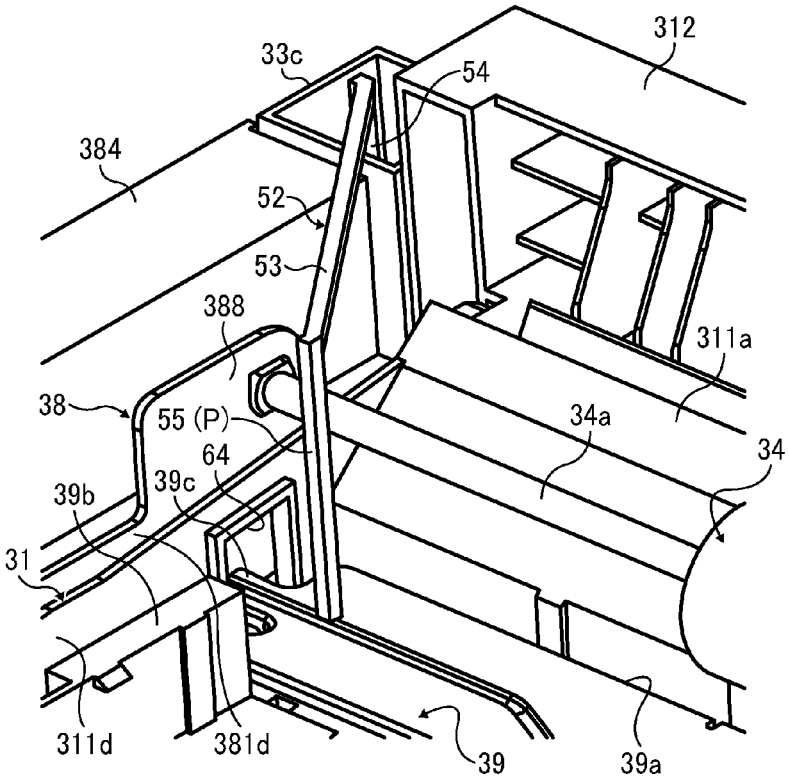

As illustrated in FIG. 12A, the base 53 of the displaying member 52 extends the first covering unit 312, the peripheral wall 381 (or the side wall 381*d*) of the support frame 38, and the peripheral wall 311 (or the front wall 311*a* and the side wall 311*d*) of the medium container 31 and extends toward an interior of the medium container 31. A leading end of the leg 55 of the displaying member 52 contacts the bottom plate 39 disposed inside the medium container 31. In the present embodiment, the leg 55 contacts the bottom plate 39 and forms a contact portion P.

The contact portion P is configured to contact a position near the leading end 39*a* of the bottom plate 39 where the stack of recording media is not placed on the bottom plate 39. There is a case in which a width regulating member 39*b* to widthwise regulate the stack of recording media is disposed at both lateral ends of the bottom plate 39 (see, for example, FIG. 7). In such a case, the position where the stack of recording media is not placed is an outside area rather than the inner side of the width regulating member 39*a* among the surface area of the bottom plate 39. When the position of the width regulating member 39*b* is adjustable in accordance with the width of the recording medium, the contact portion P is to be contacted to the outside area rather than the inner side of the width regulating member 39*b*, which is slid to a position corresponding to a maximum width of the stack of recording media.

Figure 12B:
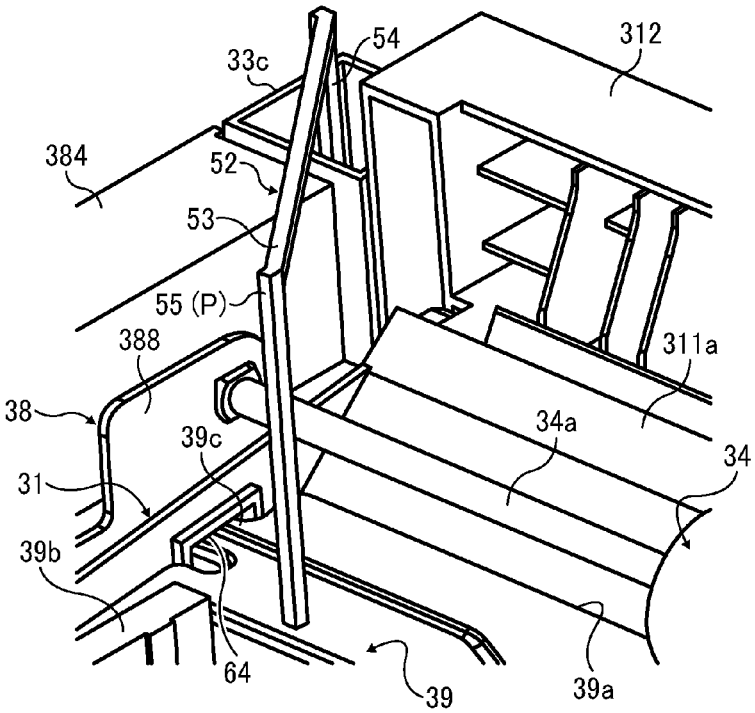

As illustrated in FIG. 12A, a grooved stopper 64 is disposed on the side wall 311*d* of the medium container 31 and on the side wall 381*d* of the support frame 38. The grooved stopper 64 penetrates through both the side wall 311*d* and the side wall 381*d*. A projection 39*c* is formed at a leading end of the bottom plate 39 and is projected widthwise. By contacting the projection 39*c* with the stopper 64, an upper position of the bottom plate 39 is restricted (see FIG. 12B). When the projection 39*c* is provided to the bottom plate 39, the contact portion P may be configured to contact the projection 39*c*.

In the description above, the contact portion P is caused to contact near the leading end 39*a* of the bottom plate 39; however, alternatively the contact portion P can be contacted a base side (i.e., at a support axis O side) of the bottom plate 39. In this case, because a distance between the contact portion P and the display 51 increases, the displaying member 52 gets larger in size. To prevent this, a suitable link mechanism is preferably disposed between the contact portion P and the display 51.

Figure 14A:
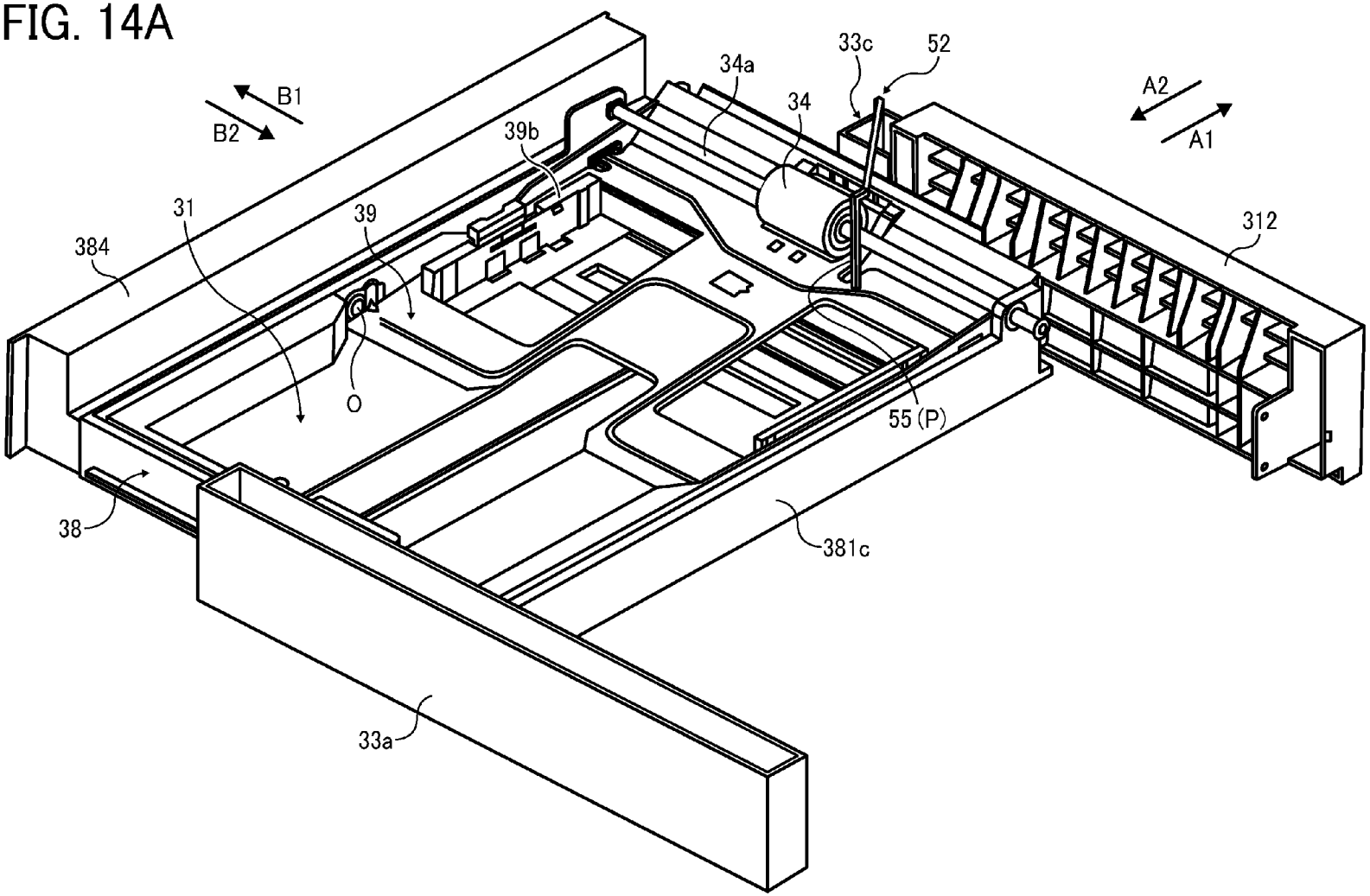
FIGS. 14A and 14B are oblique views of the sheet feed unit illustrating an interim state in which the medium container is pulled out from the sheet feed unit main body in the second removal direction.
Figure 14B:
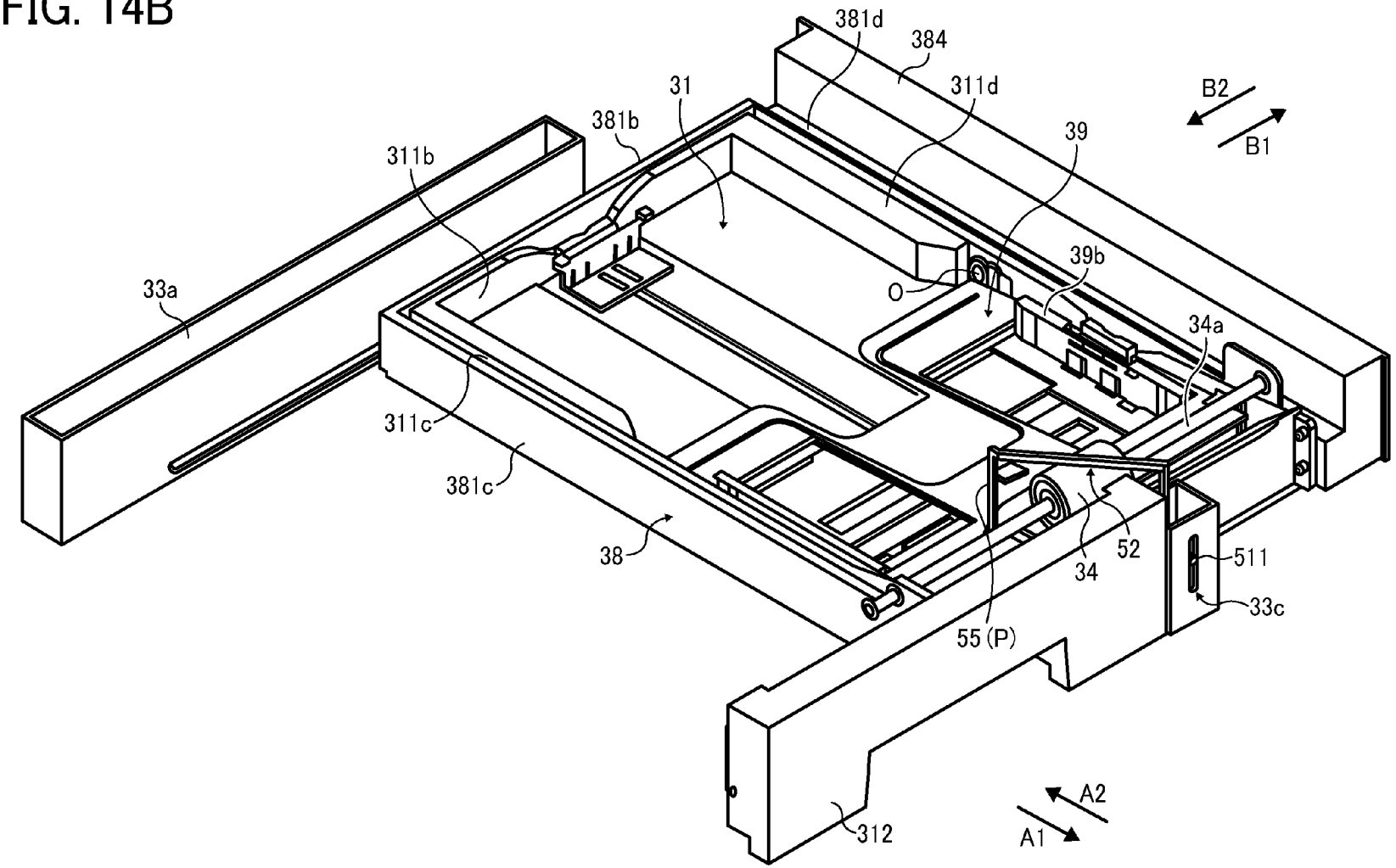
Figure 15:
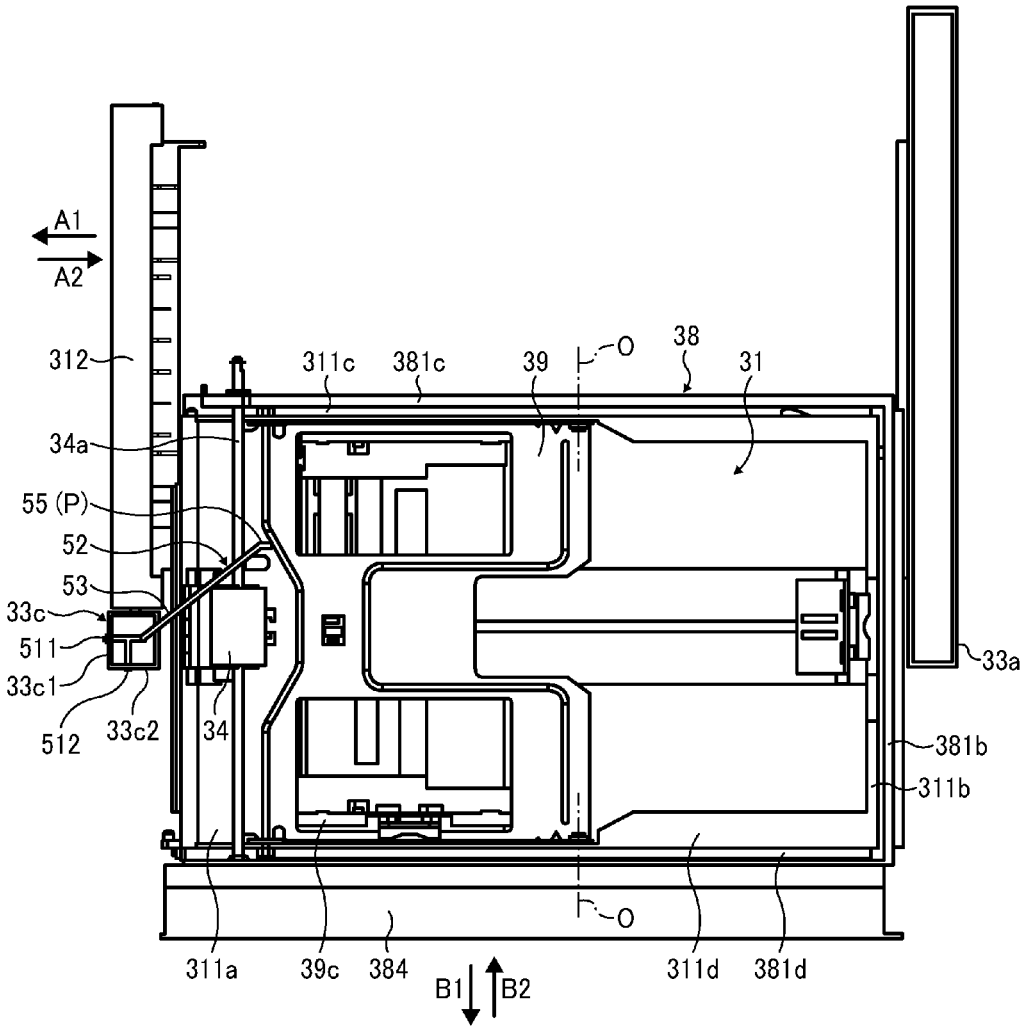
FIG. 15 is a plan view illustrating an interim state in which the medium container is pulled out from the sheet feed unit main body in the second removal direction.

As described above, when the medium container 31 is pulled out or inserted in the second operation in the directions B1 and B2, the support frame 38 and the sheet feed roller 34 move in the same direction accompanied by the medium container 31 (see FIGS. 8A to 8D). Therefore, it is necessary to design each part of the displaying member 52 not to interfere with the sheet feed roller 34 moving following the second operation. Specifically, as illustrated in FIGS. 14A and 14B and FIG. 15, dimensions of each part need to be precisely defined so that the sheet feed roller 34 that moves responsive to the second operation can pass through a space surrounded by the first covering unit 312, the base 53 of the displaying member 52, and the contact portion P. Specifically, the contact portion P is caused to contact the bottom plate 39 at a side nearer to the base side (i.e., the support axis O side) than a moving locus formed by the sheet feed roller 34 in the second operation, and the base 53 of the displaying member 52 is positioned above the moving locus thereof. When the gear 41 mounted on the rotary shaft 34*a* of the sheet feed roller 34 has a diameter larger than that of the sheet feed roller 34, each part of the displaying member 52 needs to be designed so as to prevent interference with the gear 41 in addition to the interference with the sheet feed roller 34. Because normally the gear 41 has a diameter smaller than that of the sheet feed roller 34, there is no need to consider prevention of the interference with the gear 41 in designing the displaying member 52.

To simplify a structure of the remaining level displaying unit 50, the contact portion P is preferably configured to contact the bottom plate 39 by the weight of the displaying member 52. In this case, a weight is disposed at a suitable position of the displaying member 52 so as to bias the displaying member 52 in a contact direction with the bottom plate 39. In addition, an elastic force produced by an elastic member is applied to the displaying member 52, if necessary, and the displaying member 52 can be biased by the elastic force in the direction contacting the bottom plate 39.

Next, a basic operation of the remaining level displaying unit 50 will now be described.

Figure 13A:
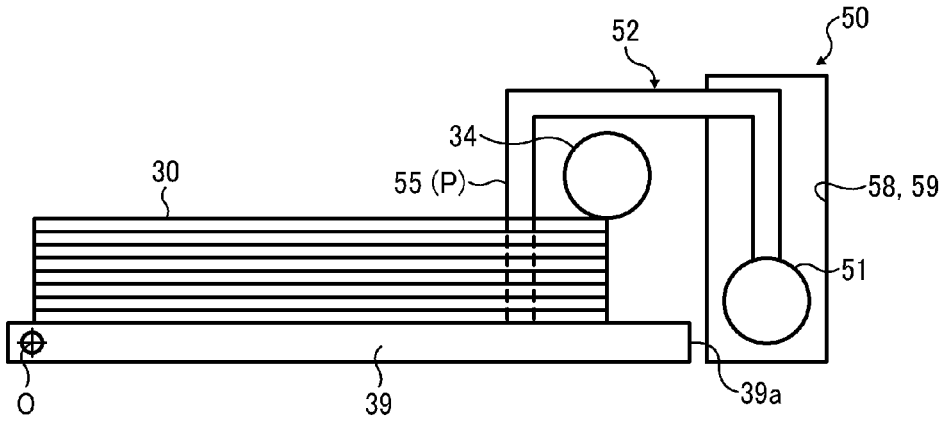

As illustrated in FIG. 13A, the leading end 39*a* of the bottom plate 39 is positioned at the lowest position in a state in which the stack of recording media 30 is fully stacked on the bottom plate 39. Accordingly, the contact portion P to contact the bottom plate 39 and the displaying member 52 are also positioned at the lowest position, and the displays 51 (i.e., the first display 511 and the second display 512) disposed on the displaying member 52 each are at the lowest position in the windows 58 and 59. Accordingly, by viewing the display 51, it can be ascertained that the stack of recording media is fully stacked.

Figure 13B:
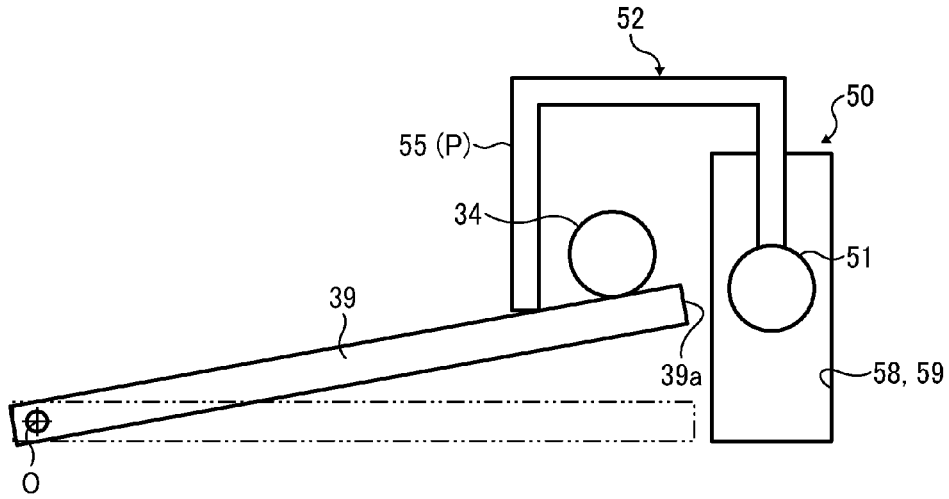

When the stack of recording media on the bottom plate 39 decreases, the bottom plate 39 rotates about the support axis O in accordance with a decrease in the weight of the stack of recording media 30 and the leading end 39*a* of the bottom plate 39 is lifted up. Following the rising of the bottom plate 39, the contact portion P and further an entire displaying member 52 move upwards and the displays 51 inside the windows 58 and 59 move upwards. As illustrated in FIG. 13B, when there are no more recording media on the bottom plate 39, the displaying member 52 gets to the highest position and the display 51 reaches the most lifted up position. Because the position of the display 51 in the windows 58 and 59 changes responsive to the remaining level of the stack of recording media 30, the remaining level of the recording medium P can be recognized simply by viewing the display 51. Because the uplifted width of the bottom plate 39 and the uplift amount of the display 51 are proportional to each other, the remaining level of the recording medium can be accurately recognized by checking the position of the display 51 in the windows 58 and 59.

When the first operation or the second operation is performed to the medium container 31 for supplying the recording media or removing the paper jam, there is an occasion in which the displaying member 52 (in particular, the contact portion P) disposed at the side of the main body of the sheet feed unit 33 interferes with any other member (such as, for example, the peripheral wall 311 of the medium container 31, the peripheral wall 381 of the support frame 38, the stack of recording media 30 on the bottom plate 39, or otherwise the width regulating member 39*b*). Such interference affects insertion or removal operation of the medium container 31 and an abrupt operation of the medium container 31 may cause damage to the displaying member 52. The displaying member 52 may be moved to protect it from the interference area with the peripheral walls 311 and 381 manually; however, the burden increases when performing the first operation or the second operation.

Figure 16A:
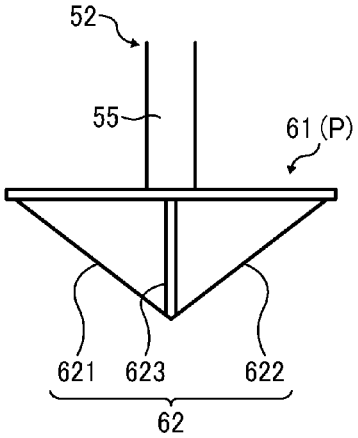
Figure 16B:
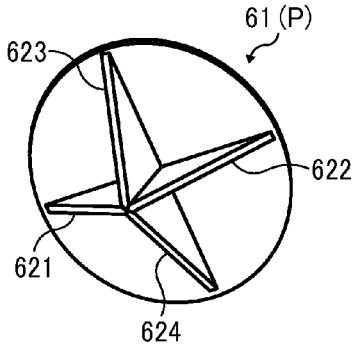

To solve this problem, in order to prevent such an interference between the two, it is preferable to provide a run-off portion 62 to either or both of the displaying member 52 and the parts interfering with the displaying member 52 so as to prevent interference of the two parts. The run-off portion 62 can be implemented as tapered surfaces 621 to 624 formed on the displaying member 52 as illustrated in FIGS. 16A and 16B. In the illustrated example, a guide member 61 is provided at a leading end of the leg 55 of the displaying member 52. The guide member 61 is provided with four tapered surfaces 621 to 624, each corresponding to the first removal direction A1, the first insertion direction A2, the second removal direction B1, and the second insertion direction B2, respectively. The guide member 61 includes four triangular plates formed radially thereon and slanted sides of the triangular plates serve as the tapered surfaces 621 to 624. A bottom end of each of the tapered surfaces 621 to 624 contacts together at the bottom of the guide member 61 and the contacted portion contacts the bottom plate 39 and slides on the bottom plate 39. Accordingly, the guide member 61 serves as the contact portion P in this structure. The guide member 61 may be integrally formed with the leg 55. Alternatively, the guide member 61 and the leg 55 may be separately formed and bonded together with an adhesive material, for example. A height or a size of the tapered surfaces 621 to 624 is to be positioned at a position at least exceeding an upper end of other interfering parts (for example, the peripheral wall 311).

Hereinafter, an operation of the guide member 61 to prevent interference of the obstacle will now be described with reference to FIGS. 17A and 17B.

Figure 17A:
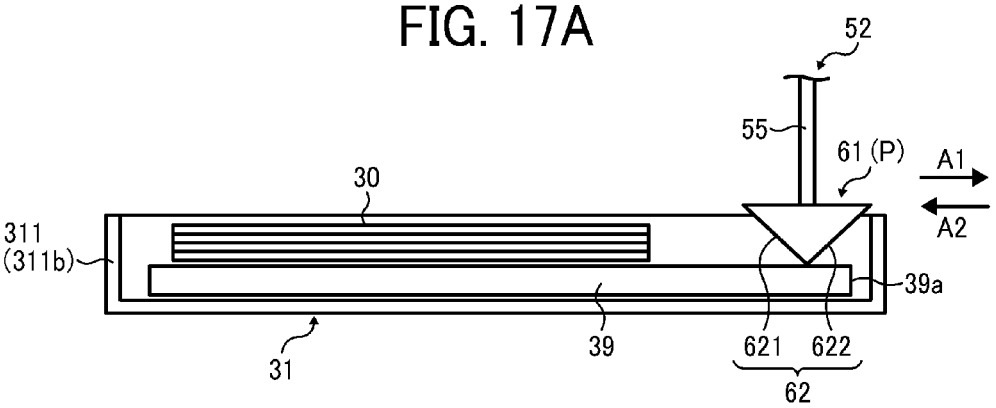
Figure 17B:
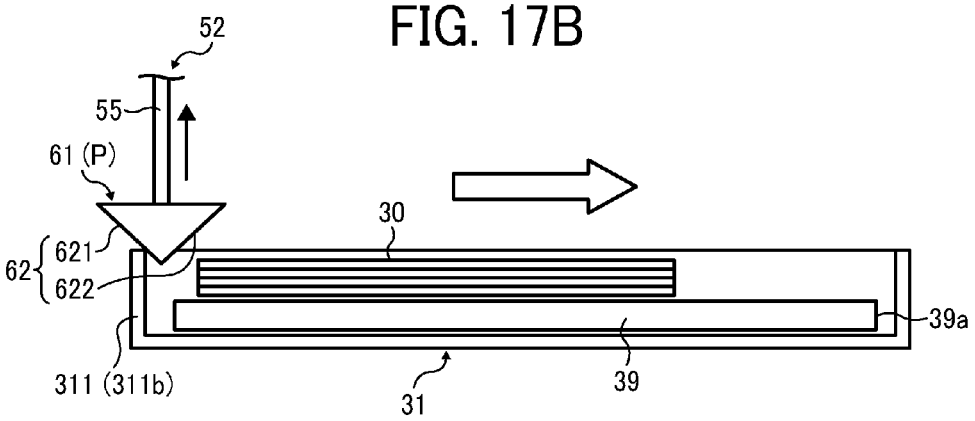

When the medium container 31 is pulled out in the first removal direction A1 from a state in FIG. 17A, the guide member 61 as the contact portion P passes through a side of the stack of recording media 30 stacked on the bottom plate 39 and reaches the peripheral wall 311 (i.e., the rear wall 311*b*). When the medium container 31 is further moved in the first removal direction A1, the guide member 61 which has contacted the peripheral wall 311 escapes upwards guided by the tapered surface 621 and gets over the peripheral wall 311 as illustrated in FIG. 17B. As a result, because the displaying member 52 goes up and interference with the peripheral wall 311 is avoided, the medium container 31 can be pulled out toward outside. Even though the guide member 61 contacts the width regulating member 39*b* while passing through the stack of recording media 30, the guide member 61 escapes upwards guided by the tapered surface 621 similarly, thereby preventing the interference between the guide member 61 and the width regulating member 39*b*.

When the medium container 31 is reversely inserted in the first insertion direction A2 from the above state, the guide member 61 which has contacted the peripheral wall 311 escapes upwards guided by the tapered surface 622, gets over the peripheral wall 311, and contacts a surface of the bottom plate 39 with its own weight of the displaying member 52. Then, the operation returns to an initial state as illustrated in FIG. 17A. Then, the interference between the displaying member 52 and the peripheral wall 311 of the medium container 31 can be avoided, and the insertion/removal of the medium container 31 can be performed smoothly. It is to be noted that the movement and function of the guide member 61 is explained when the medium container 31 is subjected to the first operation (i.e., the insertion/removal in the directions A1 and A2 in the above description. However, the movement and function of the guide member 61 is similarly performed when the medium container 31 is subjected to the second operation (i.e., the insertion/removal in the directions B1 and B2).

The tapered surface as the run-off portion 62 may be disposed on the counterpart interfering object contacting the displaying member 52 such as the peripheral wall 311 or 381, for example. The tapered surface may further be formed on the both of the displaying member 52 and the interfering object.

Figure 18:
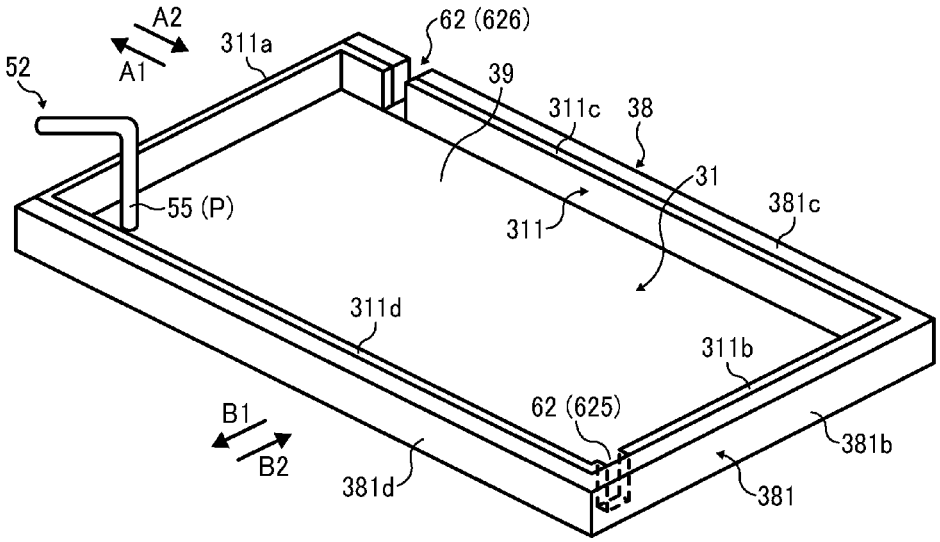
FIG. 18 is an oblique view illustrating the sheet feed unit and a support frame in a separated state.

As illustrated in FIG. 18, the run-off portion 62 can be implemented by slits 625 and 626 formed on the peripheral wall 311 of the medium container 31 and on the peripheral wall 381 of the support frame 38. When providing the slits 625 and 626 in the passing area of the leg 55 in the first operation and the second operation, similarly to the embodiment as illustrated in FIGS. 17A and 17B, interference between the displaying member 52 and the peripheral wall 311 of the medium container 31 and with the peripheral wall 381 of the support frame 38 can be avoided and the insertion/removal of the medium container 31 in the first and second operations can be performed smoothly.

In the first operation in which the medium container 31 and the support frame 38 are separated, the slit 625 corresponding to the insertion/removal directions A1 and A2 may be formed on the rear wall 311*b* of the medium container 31 alone. (That is, formation of the slit on the rear wall 381*b* of the support frame 38 is not necessary.) On the other hand, when the medium container 31 is inserted or pulled out integrally with the support frame 38 as in the second operation, the slit 626 corresponding to the insertion/removal directions B1 and B2 needs to be formed on both of the side wall 311*c* of the medium container 31 and the side wall 381*c* of the support frame 38.

In either of the first and second operations, the stack of recording media 30 is normally contained on the bottom plate 39 inside the medium container 31 when the medium container 31 is inserted (in the A2 and B2 directions). When, as illustrated in FIG. 18, the slits 625 and 626 are formed, because the contact portion P passes by the side of the stack of recording media 30, no interference occurs between the contact portion P and the stack of recording media 30 in the insertion in the first insertion direction A2. However, in the insertion in the second insertion direction B2, when the stack of recording media 30 is fully stacked inside the medium container 31, because the contact portion P passing over the slit 626 interferes with the stack of recording media 30, the medium container 31 may not be inserted smoothly.

Figure 19A:
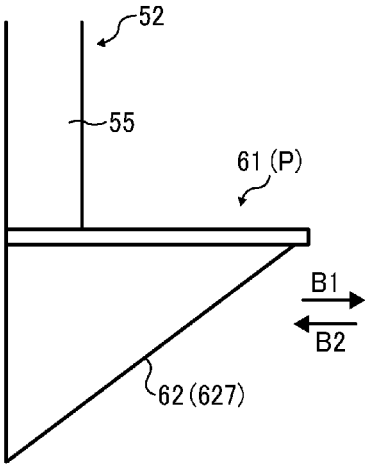
Figure 19B:
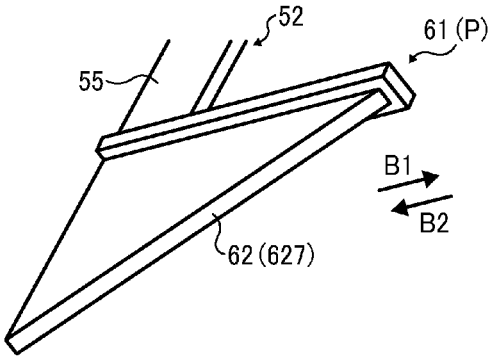

To cope with such a problem, as illustrated in FIGS. 19A and 19B, it is preferable that a tapered surface 627 facing the second insertion direction B2 be provided on the displaying member 52 as a run-off portion 62. The tapered surface 627 is constructed such that the guide member 61 including a triangular plate is attached to the leg 55 of the displaying member 52 as illustrated in the figures. The guide member 61 serves as the contact portion P in the present embodiment. Then, in addition to the slits 625 and 626 on the peripheral wall 311, at least the tapered surface 627 facing the second insertion direction B2 is disposed on the guide member 61 which is disposed on the leg 55. As a result, interference between the displaying member 52 and the stack of recording media 30 can be prevented and the insertion operation of the medium container 31 in the second insertion direction B2 can be performed accurately. Further, if needed, one or two or three tapered surface corresponding to each direction A1, A2, or B1 other than the B2 direction can be added to the guide member 61 illustrated in FIGS. 19A and 19B.

Some of the non-predictable effects that the sheet feed unit 2 including the thus-configured remaining level displaying unit 50 achieve are described below.

(1) As the display 51 representing the remaining level of the recording media contained in the medium container 31, the first display 511 representing the remaining level of the recording media seen from the first direction (for example, the first removal direction A1) and the second display 512 representing the remaining level of the recording media seen from the second direction (for example, the second removal direction B1) are provided, thereby enabling to see the display 51 from at least two directions. Accordingly, because an observable area of the display 51 when installing the image forming apparatus 1 expands, the remaining level can be seen from a wide area around the installation site.

Figure 20:
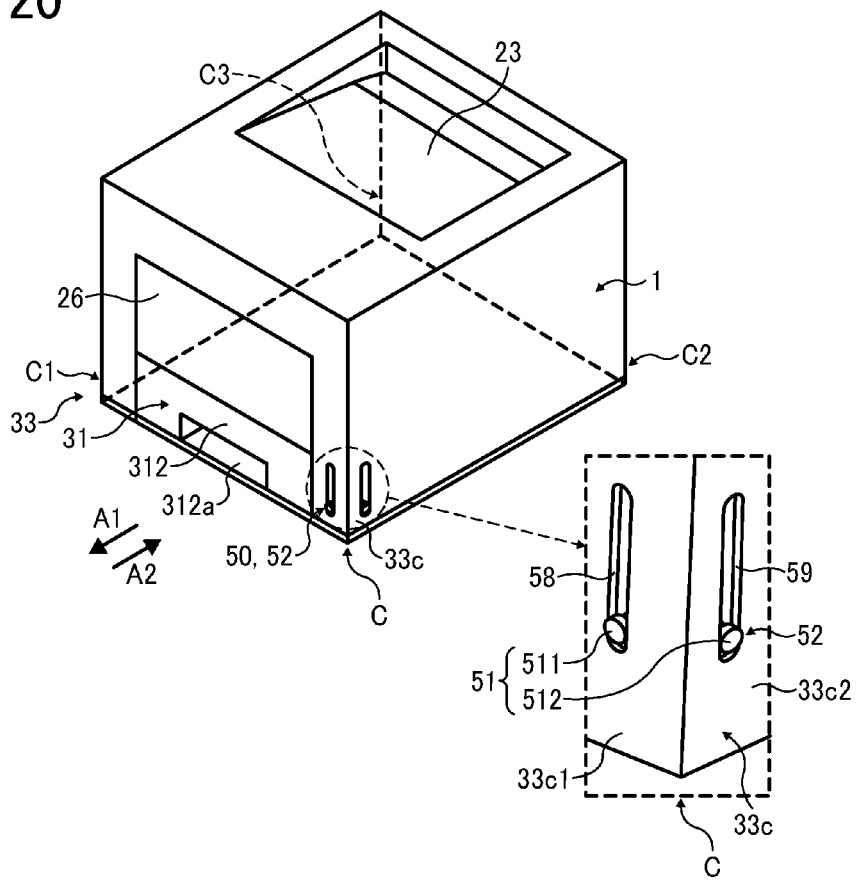
FIG. 20 is an oblique view of the image forming apparatus illustrating its overall structure and an enlarged partial view thereof according to another embodiment of the present invention.

The same effect can be obtained for the sheet feed unit 2 in which the insertion/removal direction of the medium container 31 is limited to one of the A1 and A2 directions as illustrated in FIG. 20, not limited to the sheet feed unit 2 having two insertion/removal directions of the medium container 31 as illustrated in FIG. 9 and the like.

(2) Because the medium container 31 can be pulled out in the sheet feed direction A1 and the sheet feed direction B1 perpendicular to the sheet feed direction A1 with respect to the main body of the sheet feed unit 33, even when there is an obstacle such as a wall in either of the above two directions and it is difficult to pull the medium container 31 out in the blocked direction, the medium container 31 can be pulled out in one of the above two directions and the replenishing work of the stack of recording media and the operation to remove a paper jam can be performed smoothly. Thus, even though observing one of the first display 511 and the second display 512 may be difficult, the other display can be observed and the remaining level of the recording media can be ascertained. While keeping the remaining level observing function, the installation site of the image forming apparatus can be selected from among various places.

(3) The first display 511 and the second display 512 are preferably disposed at the corner portion C adjacent to each of a passing area where the medium container 31 passes when pulled out in the first removal direction A1 and to another passing area where the medium container 31 passes when pulled out in the second removal direction B1. If the first display 511 and the second display 512 are disposed at different corner portions, a joint path between the two displays becomes longer and complicated so that errors may occur in the remaining level represented by the both displays 511 and 512. If disposed at the same corner portion, the first display 511 and the second display 512 can be accurately coupled with each other and the errors may be minimized.

(4) The contact portion P is contacted by the bottom plate 39, is moved following the movement of the bottom plate 39, and is coupled with the movement of the display 51 mechanically, thereby manufacturing the remaining level displaying unit 50 to be low cost and compact in size. In showing the remaining level, the movement of the bottom plate 39 can be detected by a sensor or the like, and the detected information can be transmitted to the display electrically to display the detected result. However, such a system requires many electronic parts and wiring, thereby increasing the cost for parts and assembly.

(5) In the present invention, by contrast, the contact portion P is contacted by the bottom plate 39 and the movement of the bottom plate 39 is transmitted mechanically to the display 51. If the contact portion P is caused to contact a portion near the leading end 39*a* of the bottom plate 39 at which a moving amount of the bottom plate 39 corresponding to the remaining level of the recording media is largest, the display 51 moves the farthest, which is most effective to clarify the change in the remaining level of the recording media. When the display 51 is disposed at the corner portion C as described above, the display 51 can be contacted near the leading end 39*a* of the bottom plate 39 easily, thereby further clearly showing the remaining level with such an uncomplicated structure. In addition, even in a case where the medium container 31 is inserted or pulled out in two directions, the interference between the remaining level displaying unit 50 and the medium container 31 or other accessories such as the sheet feed roller 34 can be avoided easily, thereby enabling to further lower the cost of the remaining level displaying unit 50 and make it to be a compact device. The same effect can be obtained even though the display 51 is disposed at another corner portion C1 at a side in the first removal direction A1 (see FIG. 9) of the main body of the sheet feed unit 33 in addition to the corner portion C. If no other problem exists, the display 51 can be disposed at other corner portions C2 or C3 in the first insertion direction A2 of the main body of the sheet feed unit 33.

(6) The medium container 31 can be pulled out in the sheet feed direction A1 via the sheet feed roller 34 and the sheet feed direction B1 perpendicular to the sheet feed direction A1 and the display 51 showing the remaining level of the recording media contained in the medium container 31 is disposed on the main body of the sheet feed unit 33, so that the display and related mechanism need not provided to the medium container 31, thereby achieving streamlining and the compactification of the medium container 31. With this structure, a relation between the removal direction of the medium container 31 and the observable direction of the display 51 can be separated. In the conventional image forming apparatus, the display is mainly disposed at the medium container 31 (as disclosed in JP-H9-2672-A and JP-2007-223689-A). If this structure is applied to the sheet feed unit realizing a removal in the two directions as embodied in the present medium container 31, because the removal direction of the medium container 31 and the observable direction of the display 51 are basically coincident, the observable range of the display 51 is limited. To the contrary, with the structure above, because the display 51 observable direction can be defined without regard to the removal direction of the medium container 31, the observable range of the display 51 is variable, thereby improving the useablity of the image forming apparatus 1. The present effect can be obtained by not only the sheet feed unit 2 having two displays (i.e., the first display 511 and the second display 512) but the sheet feed unit 2 having a single display alone.

(7) The remaining level displaying unit 50 is formed of the displaying member 52 including the display 51 and the contact portion P which are integrally formed, thereby streamlining the structure of the remaining level displaying unit 50. With this structure, the number of parts and the amount of the materials to be used for the remaining level displaying unit 50 can be reduced, thereby making the cost of the sheet feed unit 2 to be reduced.

Hereinafter, another embodiment of the sheet feed unit 2 according to the present invention will now be specifically described.

Figure 21:
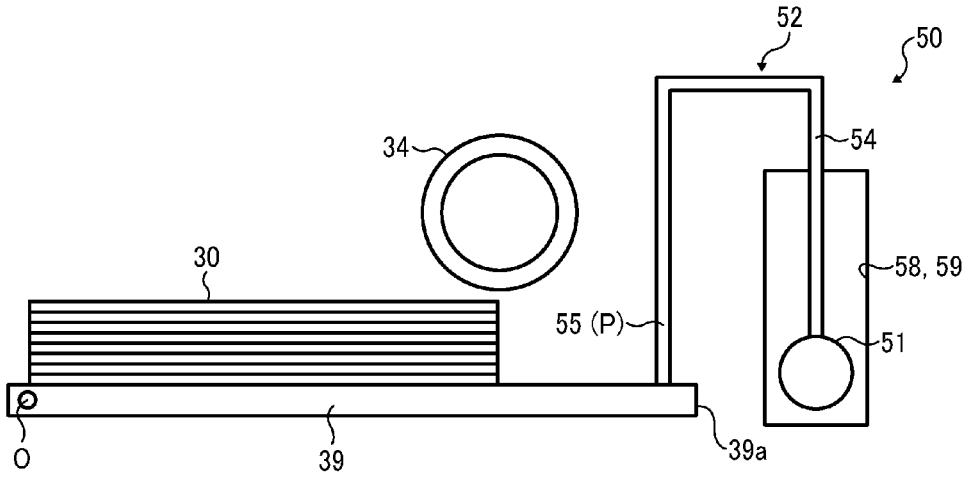
FIG. 21 is a side view schematically illustrating a mechanism to display a remaining level of the recording medium according to another embodiment of the present invention.

In the above embodiment, the contact portion P is contacted to the bottom plate 39 at a side nearer the base of the bottom plate (i.e., a side of the support axis O) than the sheet feed roller 34, but the contact portion P can be contacted to the bottom plate 39 at a leading end nearer the bottom plate than the sheet feed roller 34 as illustrated in FIG. 21. With this structure, because the contact position of the contact portion P with the bottom plate 39 comes nearer to the leading end 39*a*, the move amount of the display 51 due to the change in the remaining level of the recording media further increases, thereby improving accuracy in displaying the remaining level.

Further, in the above embodiment, the contact portion P is contacted the surface of the bottom plate 39; however, the contact position of the contact portion P with the bottom plate 39 can be arbitrary selected as long as the contact portion P can follow the movement of the bottom plate 39. For example, the contact portion P can be contacted a bottom surface of the bottom plate 39.

Figure 22A:
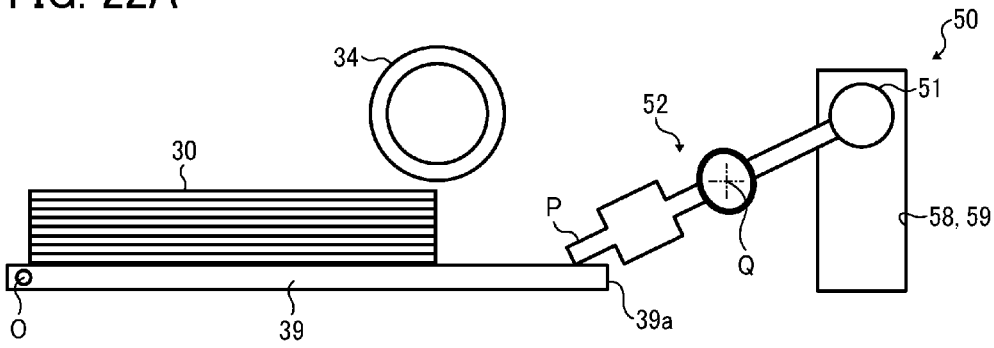
Figure 22B:
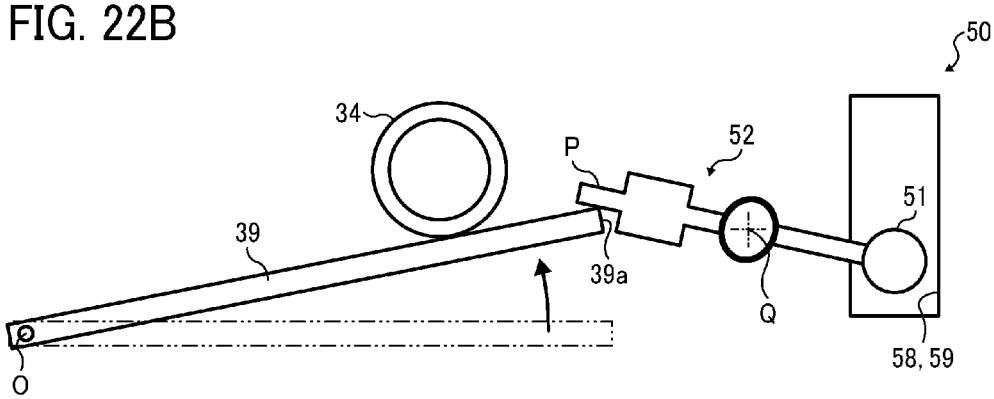

Another embodiment of the remaining level displaying unit 50 will be described referring to FIGS. 22A and 22B. In this remaining level displaying unit 50, the displaying member 52 is supported rotatably about a rotary axis Q, the contact portion P contacting the bottom plate 39 is formed at one end from the axis Q, and the display 51 is disposed at another end from the axis Q. In this structure also, the displaying member 52 rotates about the axis Q due to the change in the posture of the bottom plate 39 as illustrated in FIG. 22B and the position of the display 51 varies. As a result, the display 51 can display the remaining level of the recording media. In particular, when there is a plenty of recording media contained in the medium container 31, the display 51 is positioned above the windows 58 and 59. When the recording medium is scarce, the display 51 can be positioned at a bottom of the windows 58 and 59. This displaying method accords with a general concept regarding the remaining level of the recording media, so that the remaining level of the recording medium can be grasped intuitively.

Figure 23:
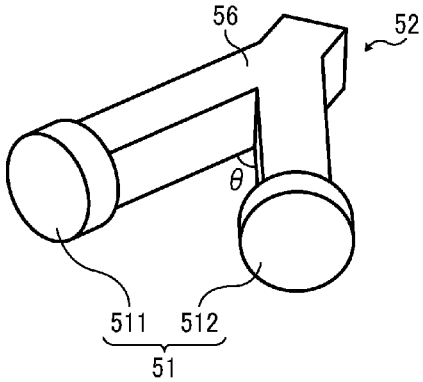
FIG. 23 is an oblique perspective view illustrating a displaying member according to another embodiment of the present invention.

FIG. 23 shows another embodiment of the displaying member 52. The displaying member 52 as illustrated in FIG. 10 includes the first display 511 and the second display 512 which are perpendicular to each other, but the displaying member 52 as illustrated in FIG. 23 includes the first display 511 and the second display 512 intersecting each other at an acute angle A of less than 90 degrees between the first direction along which the first display 511 extends and the second direction along which the second display 512 extends. In this case, the display 51 can be observed from the first direction and the second direction intersecting each other at an angle θ, thereby improving the visibility of the display 51.

Figure 24:
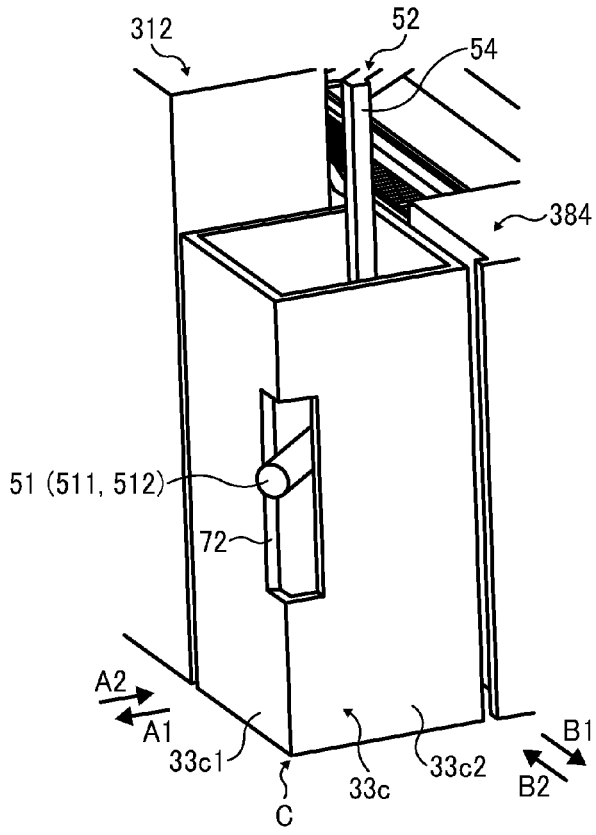
FIG. 24 is an oblique view illustrating a displaying member according to further another embodiment of the present invention.

FIG. 24 shows the displaying member 52 configured as a single display 51 which is oriented in a direction intersecting with each of the first removal direction A1 and the second removal direction B1. In the embodiment as illustrated in FIG. 24, a window 72 extending vertically is disposed at an edge of the corner portion C of the pillar 33*c* and the display 51 is disposed at the window 72. With such a structure, because the display 51 is observable from at least both the first direction (i.e., the first removal direction A1) and the second direction (i.e., the second removal direction B1), the observable direction of the display 51 can be variable similarly to the case in which the displaying member 52 is used as in the case of FIG. 10. This structure corresponds to an integral structure in which the first display 511 and the second display 512 of the displaying member 52 are not separated and integrally formed as shown in FIG. 10. (The present structure is similar to the embodiment to be described referring to FIGS. 25 to 27.)

Figure 25:
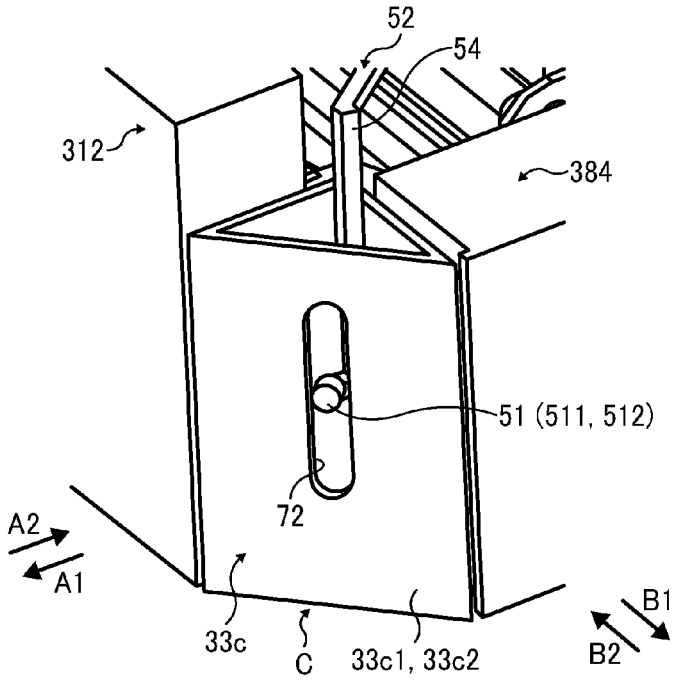
FIG. 25 is an oblique view illustrating a displaying member and a corner portion according to still further another embodiment of the present invention.
Figure 26:
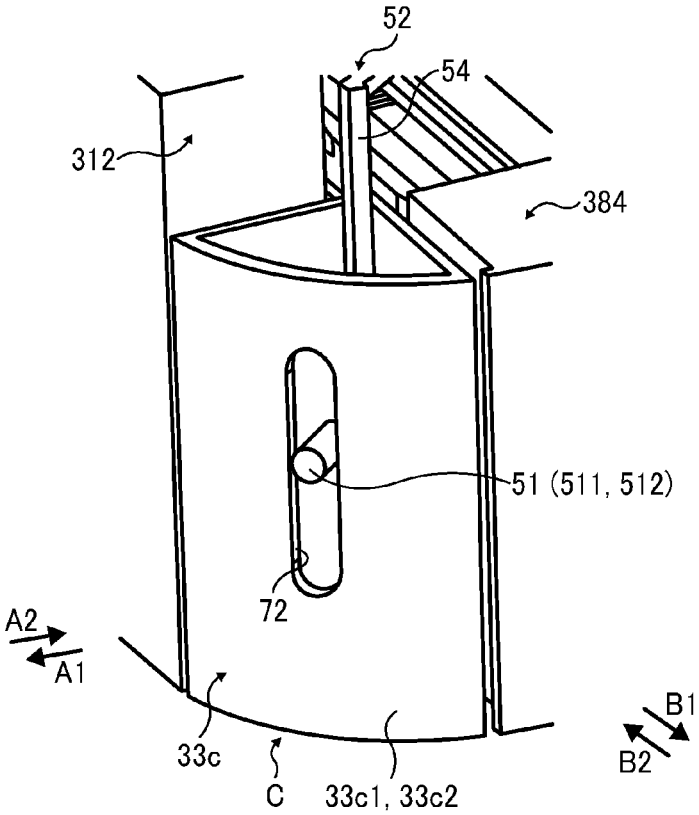
FIG. 26 is an oblique view illustrating a displaying member and a corner portion according to still further another embodiment of the present invention.

FIGS. 25 and 26 show modified examples of the structure of the corner portion C of the pillar 33*c*. Exterior surfaces of the corner portion C are formed of the first exterior surface 33*c*1 and the second exterior surface 33*c*2 which are perpendicular to each other (see FIGS. 11A and 11B). Otherwise, the exterior surfaces 33*c*1 and 33*c*2 are unified into a single plane surface as illustrated in FIG. 25 or a curved surface as illustrated in FIG. 26. In this case, similarly to the case of the example in FIG. 24, the display 51 is unique and is oriented in an intersecting direction with both of the first removal direction A1 and the second removal direction B1 so that the display 51 can be observable at least from both directions.

Figure 27:
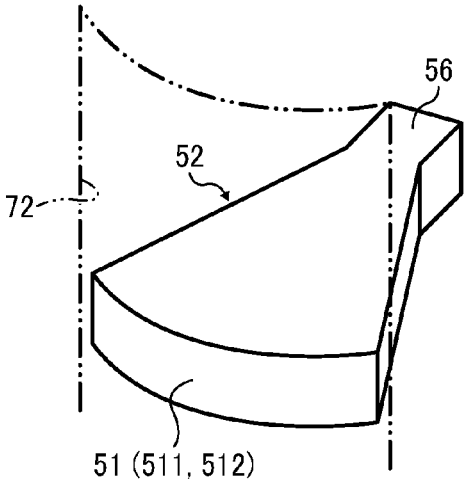
FIG. 27 is an oblique view illustrating a displaying member according to further another embodiment of the present invention.

FIG. 27 shows the displaying member 52 of which an exterior surface is formed of a circular arc surface. The displaying member 52 shaped in the circular arc is particularly suitable for the corner portion C having a curved exterior surface as illustrated in FIG. 26. If the display 51 in FIG. 27 is disposed at the window 72 formed on the curved corner portion, the display 51 can be observed at least from the first direction and the second direction.

Figure 28A:
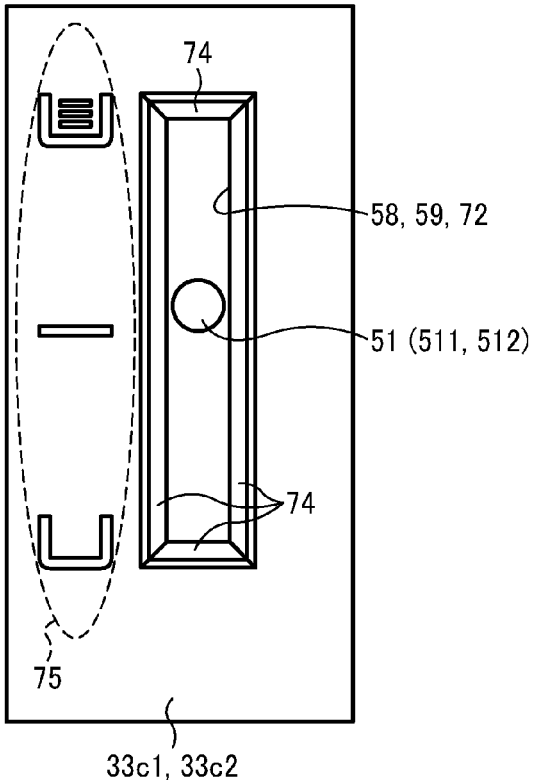
Figure 28B:
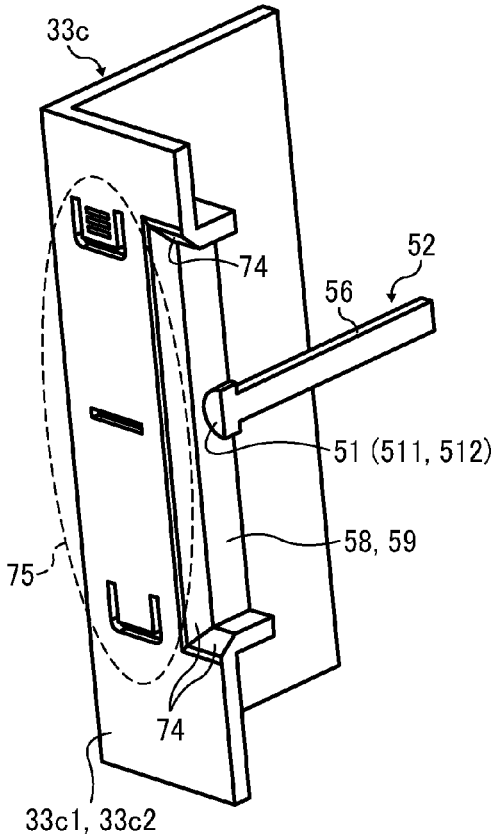

FIGS. 28A and 28B are views illustrating other examples of the windows 58, 59, and 72. In the present embodiment, a slanted surface 74 is formed on an opening edge of each of the windows 58, 59, and 72 which are disposed on the exterior surface of the main body of the sheet feed unit 33 or the pillar 33*c*. The slanted surface 74 extends an opening area of the windows from interior toward exterior. In this case, when the leading end of the display 51 (including the first display 511 and the second display 512) is disposed inside the exterior surfaces of 33*c*1 and 33*c*2 of the corner portion C, an external force to be unintentionally applied to the display 51 can be prevented, thereby improving durability of the displaying member 52. When the slanted surface 74 is formed on the opening edge of the window, the visibility of the display 51 can be improved. A part circled by a reference numeral 75 is a gauge visibly showing the remaining level of the recording media.

The sheet feed unit 2 according to the present invention may be applied to, not limited to the laser printer as illustrated in FIG. 1, other types of printers such as a monochrome image forming apparatus, an inkjet recording apparatus, a copier, a facsimile apparatus, and a multi-functional device including functions of the above devices in combination. It is also noted that various modifications can be applied to the above printers without distorting from the substantial features of the present invention.

Additional modifications and variations of the present invention are possible in light of the above teachings. It is therefore to be understood that, within the scope of the appended claims, the invention may be practiced other than as specifically described herein.

What is claimed is:

1. A sheet feed unit comprising:

a medium container configured to contain recording media;

a bottom plate disposed in the medium container, on which the recording media is stackable;

a sheet feed device configured to feed out the recording media contained in the medium container;

a main body of the sheet feed unit, which the medium container can be inserted into and pulled out from, including the sheet feed device; and a displaying member configured to display a remaining level of the recording media contained in the medium container, the displaying member including a first display oriented in a first direction and a second display oriented in a second direction perpendicular to the first direction, wherein the first display and the second display are arranged vertically with respect to the bottom plate at a same corner portion of the main body of the sheet feed unit.

2. The sheet feed unit as claimed in claim 1, wherein the medium container is configured to be pulled out in two directions, a first direction via the sheet feed device and a second direction perpendicular to the first direction.

3. The sheet feed unit as claimed in claim 2, wherein the first display and the second display are disposed at a corner portion adjacent to each of a first passing area through which the medium container passes when pulled out in the first direction and to a second passing area through which the medium container passes when pulled out in the second direction perpendicular to the first direction.

4. The sheet feed unit as claimed in claim 1, further comprising a contact portion contacting the bottom plate and moving responsive to a movement of the bottom plate, wherein the first display and the second display are configured to move responsive to the contact portion.

5. The sheet feed unit as claimed in claim 4, wherein the contact portion, the first display, and the second display are formed as a single integrated unit.

6. The sheet feed unit as claimed in claim 4, further comprising a run-off portion, disposed to either or both of the contact portion or parts interfering with the contact portion during insertion/removal of the medium container with respect to the main body of the sheet feed unit so as to prevent interference between the medium container and the main body of the sheet feed unit.

7. The sheet feed unit as claimed in claim 6, wherein the run-off portion comprises tapered surfaces.

8. The sheet feed unit as claimed in claim 1, wherein the first and the second displays form a single integrated unit.

9. The sheet feed unit as claimed in claim 1, further comprising a window disposed in an exterior surface of the main body of the sheet feed unit, wherein the displaying member is disposed at the window.

10. The sheet feed unit as claimed in claim 9, wherein the window includes a slanted surface formed on an opening edge thereof, the slanted surface extending an opening area of the window outward from interior toward exterior.

11. The sheet feed unit as claimed in claim 9, wherein a leading edge of the displaying member is recessed in the exterior surface of the sheet feed unit.

12. An image forming apparatus comprising a sheet feed unit as claimed in claim 1.

13. A sheet feed unit comprising:

a medium container configured to contain sheet-like recording media;

a bottom plate disposed in the medium container and configured to place the recording media thereon;

a sheet feed device configured to feed out the recording media contained in the medium container;

a main body of the sheet feed unit, which the medium container can be inserted into and pulled out from, including the sheet feed device, wherein the sheet feed unit is configured to enable the medium container to be pulled in a sheet feed direction via the sheet feed device and in a direction perpendicular to the sheet feed direction; and a displaying member to display a remaining level of a stack of recording media contained in the medium container disposed in the main body of the sheet feed unit, wherein the displaying member is arranged vertically with respect to the bottom plate at a corner portion of the main body of the sheet feed unit.

14. The sheet feed unit as claimed in claim 13, wherein the displaying member is disposed at a corner portion adjacent to each of a first passing area through which the medium container passes when pulled out in the sheet feed direction and to a second passing area through which the medium container passes when pulled out in the direction perpendicular to the sheet feed direction.

15. The sheet feed unit as claimed in claim 13, further comprising a contact portion, wherein the displaying member is movable responsive to a moving of the contact portion.

16. The sheet feed unit as claimed in claim 15, wherein the contact portion and the displaying member form a single integrated unit.

17. The sheet feed unit as claimed in claim 13, wherein the contact portion contacts the bottom plate outside an area where the stack of recording media is placed.

18. The sheet feed unit as claimed in claim 13, wherein the displaying member includes a first display oriented in a first direction and a second display oriented in a second direction perpendicular to the first direction.

19. The sheet feed unit as claimed in claim 13, wherein the displaying member is disposed in a direction intersecting with both the sheet feed direction and the direction perpendicular to the sheet feed direction.

* * * * *